US008157190B2

(12) United States Patent
Onda

(10) Patent No.: US 8,157,190 B2
(45) Date of Patent: Apr. 17, 2012

(54) AIR ATOMIZING TYPE COATING APPARATUS

(75) Inventor: Toshio Onda, Edogawa-ku (JP)

(73) Assignee: ABB K.K., Tokyo (JP)

( * ) Notice: Subject to any disclaimer, the term of this patent is extended or adjusted under 35 U.S.C. 154(b) by 460 days.

(21) Appl. No.: 12/520,126

(22) PCT Filed: Dec. 5, 2007

(86) PCT No.: PCT/JP2007/073893

§ 371 (c)(1),
(2), (4) Date: Jun. 19, 2009

(87) PCT Pub. No.: WO2008/096501

PCT Pub. Date: Aug. 14, 2008

(65) Prior Publication Data

US 2010/0001099 A1 Jan. 7, 2010

(30) Foreign Application Priority Data

Feb. 8, 2007 (JP) ..... 2007-029294

(51) Int. Cl.
*B05B 1/28* (2006.01)

(52) U.S. Cl. ..... 239/296; 239/305

(58) Field of Classification Search ..... 239/290, 239/291, 296, 418, 303–305, DIG. 14
See application file for complete search history.

(56) References Cited

U.S. PATENT DOCUMENTS 6,164,561 A 12/2000 Yoshida et al.
6,458,424 B1 * 10/2002 Yoshida et al. ..... 427/426
6,612,345 B1 * 9/2003 Hosoda et al. ..... 141/20.5
6,666,164 B2 * 12/2003 Yoshida et al. ..... 118/323
6,742,722 B2 * 6/2004 Hosoda et al. ..... 239/305
2003/0234299 A1 12/2003 Hosoda et al.

FOREIGN PATENT DOCUMENTS

| | | |
|---|---|---|
| JP | 1 317563 | 12/1989 |
| JP | 7 194998 | 8/1995 |
| JP | 11 262699 | 9/1999 |
| JP | 2003 117447 | 4/2003 |
| JP | 2003 175348 | 6/2003 |

* cited by examiner

*Primary Examiner* — Davis Hwu

(74) *Attorney, Agent, or Firm* — Oblon, Spivak, McClelland, Maier & Neustadt, L.L.P.

(57) ABSTRACT

There is provided an air atomizing type coating apparatus which is constituted by a main body (2) having a first feed tube passage hole (6) extended forward from a cartridge mount portion (5), a passage change-over mechanism (11) attached to the front side of the main body (2) to change over positions of a second feed tube passage hole (14) and a second wash fluid passage (15), a spray nozzle (22) attached on the front side of the passage change-over mechanism (11), and a paint cartridge (30) to be set in the cartridge mount portion (5). Upon shifting the passage change-over mechanism (11) to a coating position, the first and second feed tube passage holes (6) and (14) are brought into communication with each other, a coating operation can be performed by inserting a paint cartridge (30). On the other hand, upon shifting the passage change-over mechanism (11) to a washing position, the first and second wash fluid passages (9) and (15) are brought into communication with each other, permitting a supply of a wash fluid to the spray nozzle (22).

8 Claims, 14 Drawing Sheets

AIR ATOMIZING TYPE COATING APPARATUS

TECHNICAL FIELD

This invention relates to an air atomizing type coating apparatus which performs coating by atomizing paint spurted out from a paint nozzle by air spurted out from an air nozzle.

BACKGROUND ART

Generally, for painting broad surface areas of a work piece such as vehicle body, furniture and electric appliance, it is the usual practice to use a rotary atomizing head type coating apparatus which can cope with large spray patterns. On the other hand, for painting small surfaces with minute ups and downs, it is often the case to resort to a pneumatic atomization or air atomizing type coating apparatus (an air spray gun) which is capable of spraying paint particles with high directionality in a straightforward direction.

An air atomizing type coating apparatus of this sort is largely constituted by a main body to be attached on a fore end portion of an arm of a coating robot or to be held in an operator's hand, an air atomizing type paint atomizing means attached to the front side of the main body and equipped a paint nozzle which spurts paint in combination with an air nozzle which is adapted to spurt jets of atomizing air to atomize paint which is being spouted out from the paint nozzle, and a paint passage for circulation of paint toward the paint atomizing means (see, for example, Patent Literature 1: Japanese Patent Laid-Open No. H1-317563).

At the time of a coating operation, the coating apparatus is connected to a color changing valve unit through a paint feed pipe, supplying paint to the paint atomizing means by way of the paint feed pipe. By atomizing air, paint is sprayed forward from the paint atomizing means in a finely divided form for deposition on a work piece. On the other hand, at the time of changing the color of paint, paint deposited on the paint feed pipe as well as the paint atomizing means are washed with wash fluids after discharging residues of a previous color from the paint feed pipe.

On the other hand, it has been known to construct an air atomizing type coating apparatus as an electrostatic coating apparatus, which is arranged to apply a high voltage to conducting paint for the purpose of enhancing paint deposition efficiency against a work piece, putting paint particles on a flight along lines of electric force which are formed between the electrostatic coating apparatus and the work piece (see, for example, Patent Literature 2: Japanese Patent Laid-Open No. H7-194998).

In this regard, in case a high voltage is applied directly to a conducting paint which is aqueous paint or metallic paint in circulation through a paint feed pipe, leakage of a high voltage to the side of earth ground takes place through paint in the paint feed pipe. Therefore, in the case of the air atomizing type coating apparatus of Patent Literature 2 mentioned above, an electrode is attached to a nose end of the paint atomizing means to form a corona discharge region forward of the coating apparatus, charging sprayed paint particles with a high voltage indirectly while they pass through the corona discharge region.

In the case of the air atomizing type coating apparatus of above-mentioned Patent Literature 1, the paint color can be changed to a new color after discharging residues of a previous color from an elongated paint feed pipe and washing away internally deposited paint from the entire length of the paint feed pipe and from the paint atomizing means as well by using a wash fluid. That is to say, on a color change, a large amount of paint has to be wastefully discarded, in addition to the necessity for a time-consuming washing operation involving consumption of large amounts of wash fluids.

Besides, in the case of the air atomizing type coating apparatus of above-mentioned Patent Literature 2, a corona discharge region is formed by an electrode which is attached to the nose end of the paint atomizing means thereby to indirectly charge paint particles with a high voltage. However, as compared with a direct charging coating apparatus, an indirect charging coating apparatus is more difficult to charge all of sprayed paint particles with a high voltage in a stable state, and thus has problems such as low paint deposition efficiency and inferior finish quality of coatings.

DISCLOSURE OF THE INVENTION

In view of the above-discussed problems with the prior art, it is an object of the present invention to provide an air atomizing type coating apparatus which can perform a coating operation with a paint cartridge filled with paint which is interchangeably attached on a main body, abolishing the use of a paint feed pipe.

It is another object of the present invention to provide an air atomizing type coating apparatus which is capable of supplying a wash fluid to an air atomizing type paint atomizing means in such a way as to complete a washing operation on the paint atomizing means efficiently in a facilitated manner.

It is still another object of the present invention to provide an air atomizing type coating apparatus directly charging paint in the air atomizing type paint atomizing means with a high voltage to guarantee higher paint deposition efficiency and finishing quality.

(1) In accordance with the present invention, in order to achieve the above-stated objectives, there is provided an air atomizing type coating apparatus, comprised of: a main body formed with a cartridge mount portion and a passage change-over means mount portion at rear and front sides thereof, respectively, along with a first feed tube passage hole extending forward from the cartridge mount portion toward the passage change-over means mount portion; a first wash fluid passage provided on the main body to supply therethrough a wash fluid for washing off paint residues; a passage change-over means attached to the passage change-over means mount portion of the main body and provided with a second feed tube passage hole which is in a coaxially communicating position relative to the first feed tube passage hole, and a second wash fluid passage which is in a communicating position relative to the first wash fluid passage, and selectively switching either the second feed tube passage hole or the second wash fluid passage; an air atomizing type spraying means attached on a front side of the passage change-over means, and composed of a paint nozzle adapted to spurt paint forward and an air nozzle adapted to blow atomizing air to atomize paint from the paint nozzle; and a paint cartridge composed of a tank portion which store paint and a feed tube projected forward from the tank portion, the feed tube being passed into the first and second feed tube passage holes and when the tank portion is set in the cartridge mount portion.

With the arrangements just described, the passage change-over means is shifted to a coating position at the time of a coating operation, bringing the second feed tube passage hole to a coaxially communicating position relative to the first feed tube passage hole. In this state, a feed tube of a paint cartridge is placed into the first and second feed tube passage holes, and a tank portion is set in the cartridge mount portion on the main body.

As soon as the coating apparatus is prepared for a coating operation in the manner as described above, paint in the tank portion is discharged from a fore distal end of the feed tube trough the feed tube. As a result, through the paint atomizing means, paint is spurted out from the paint nozzle and divided into fine particles by jets of atomizing air from the air nozzle to coat a work piece with the finely divided paint particles.

At the time of changing the paint color, a washing operation is carried out in the first place to wash off residues of a previous color. In the washing operation, the used paint cartridge is extracted from the main body. Then, the passage change-over means is shifted to a washing position, bringing the second wash fluid passage into communication with the first wash fluid passage. In this state, a wash fluid is supplied through the first and second wash fluid passages.

In this instance, the feed tube which was used as a paint passage was already extracted along with the paint cartridge, so that previous color paint is only deposited on the paint atomizing means which only needs to be cleaned by the washing operation. A wash fluid, supplied through each wash fluid passage, is vigorously gushed toward the paint atomizing means to wash off paint residues sticking on inner surfaces of the paint atomizing means from inward.

Moreover, after the completion of the washing operation, a coating operation of the next color, using other paint cartridge filled with next color carries out. For this purpose, the passage change-over means is shifted to a coating position, bringing the second feed tube passage hole into a coaxially communicating position relative to the first feed tube passage hole, and the fresh paint cartridge of the next color is set in the cartridge mount portion on the main body to start a coating operation in a next color.

Thus, a fresh paint cartridge of a next color can be attached on the main body with an air atomizing type paint atomizing means to start a coating operation in the next color, so that a color changing operation can be carried out efficiently in a facilitated manner and in such a way as to guarantee satisfactory finishing quality. Besides, the application of a paint feed system using interchangeable paint cartridges can limit the washing areas to the paint atomizing means in each washing operation, permitting to cut a washing time and consumption of wash fluids as well.

Further, the use of paint cartridges makes it possible to abolish a paint feed pipe, that is to say, a paint cartridge can be maintained in an insulated state relative to the earth ground, without possibilities of leaks of high voltage through paint even when a high voltage is applied directly to the paint. Thus, the use of paint cartridges makes it possible to apply a high voltage directly to paint to be sprayed from the paint atomizing means. It follows that, even in the case of a coating apparatus with an air atomizing type paint atomizing means, a high voltage can be stably applied to all paint particles which are sprayed from the paint atomizing means, for the purpose of improving paint deposition efficiency and finishing quality of coatings.

(2) Further, according to the present invention, wherein the passage change-over means comprises a valve case attached to the passage change-over means mount portion of the main body, a valve body rotatably fitted in the valve case and internally formed with a second feed tube passage hole and a second wash fluid passage, and an actuator adapted to turn the valve body.

Thus, when switching the mode of operation between a coating operation and a washing operation, the valve body is turned by the actuator. By so doing, the second feed tube passage hole is brought into a coaxially communicating position relative to the first feed tube passage hole at the time of a coating operation. On the other hand, at the time of a washing operation, the second wash fluid passage is brought into communication with the first wash fluid passage.

(3) In case of the air atomizing type coating apparatus in above, wherein the valve body of the passage change-over means is in the form of a spherically shaped ball valve body and internally formed with a diametrically extended second feed tube passage hole and a radially extended second wash fluid passage intersecting with each other in T-shape.

In this case, at the time of a coating operation, the valve body of the passage change-over means is turned to bring the second feed tube passage hole into communication with the first feed tube passage hole. Since the second feed tube passage hole is formed diametrically across the valve body, the feed tube of the paint cartridge which has been inserted into the first feed tube passage hole is allowed to advance through the second feed tube passage hole until its fore end is connected to the paint atomizing means.

On the other hand, at the time of a washing operation, the second wash fluid passage is shifted to a position where it is communicated with the first wash fluid passage. At this time, on a radially opposite side away from the second wash fluid passage, the valve body is closed in such a way as to block the first feed tube passage hole. Accordingly, a wash fluid from the first wash fluid passage is totally supplied to the side of the second wash fluid passage, permitting to wash the paint atomizing means in an efficient manner.

(4) Further, in the case of the air atomizing type coating apparatus in above, wherein the actuator of the passage change-over means is mounted on the main body and adapted to turn a valve shaft of the valve body.

In this case, the actuator can be mounted by using the main body and enable to shift the valve body trough a valve shaft.

(5) On the other hand, according to the present invention, the air atomizing type coating apparatus further comprising a valve seat member provided in the valve case of the passage change-over means, the valve seat member providing a hermetical seal around exterior surfaces of the valve body to prevent a wash fluid supplied from the first wash fluid passage to flow into the first feed tube passage hole.

In this case, the valve seat member is provided on the valve case of the passage change-over means to seal around outer surfaces of the valve body, preventing a wash fluid in the first wash fluid passage from flowing into the first feed tube passage hole to supply the wash fluid totally to the side of the paint atomizing means.

(6) Further, according to the present invention, the air atomizing type coating apparatus further comprising a wash fluid passage change-over valve in the course of the first wash fluid passage to switch a supply of a wash fluid from a wash fluid source device between a passage on the side of the passage change-over means and a passage on the side of an external waste liquid tank.

Accordingly, at the time of washing the paint atomizing means, the wash fluid passage change-over valve switches a supply of a wash fluid from a wash fluid source to a passage on the side of the passage change-over means. Thus, by way of the passage change-over means, a wash fluid can be supplied to the paint atomizing means for washing same.

After a washing operation, wash air needs to be supplied continually as a wash fluid to purge a wash liquid which still remains in the first and second wash fluid passages. In this regard, in case the wash liquid is of low volatility like water, it may become difficult to purge (dry off) the wash liquid completely within a predetermined washing time. Residues of a wash liquid in each wash fluid passages can cause leaks of high voltage through residues of a wash liquid when, for example, a high voltage is applied directly to paint.

To cope with this problem, in a case where the wash liquid is water, the wash fluid passage change-over valve is switched upon completion of a washing operation on the paint atomizing means to let wash air from the wash fluid feed source flow toward a waste liquid tank. Thus, wash air is supplied continually from a wash fluid passage toward the waste liquid tank after a washing operation and during a cartridge mounting operation and a paint coating operation as well to purge (dry off) a wash liquid completely in an assured manner, keeping the wash fluid passages in a dry state. This makes it possible to apply a high voltage directly to paint which is discharged from a cartridge for the purpose of improving paint deposition efficiency and finishing quality of coatings.

(7) Further, according to the present invention, the air atomizing type coating apparatus further comprising a cover adapted to enshroud outer peripheral side of the passage change-over means, which the passage change-over means being detachably attached to the passage change-over means mount portion of the main body by the use of the cover.

In this case, the passage change-over means can be protected in a concealed position under a cover. In addition, by the use of the cover, the passage change-over means can be detachably attached to the passage change-over means mount portion of the main body. Thus, replacement of the passage change-over means can be accomplished by way of a reduced number of parts and through a reduced number of steps.

(8) Further, according to the present invention, wherein the valve case of the passage change-over means is provided with a projection tube in a coaxially aligned position relative to the first feed tube passage hole of the main body and the projection tube internally defining a third feed tube passage hole to receive therein a fore end portion of the feed tube; the paint nozzle of the paint atomizing means is comprised of a paint nozzle body attached on a front side of the passage change-over means, a projection tube receptacle hole formed on the rear side of the paint nozzle body to receive therein the projection tube, and a paint spurting hole formed at a fore end of the paint nozzle body to spout paint in supply through the projection tube; and the air nozzle is comprised of an air nozzle body located around outer periphery of the paint nozzle body and attached to the passage change-over means through a retainer ring, atomizing air spurting holes formed in the air nozzle body at positions around the paint spurting hole of the paint nozzle body, and pattern air spurting holes formed in horn portions in diametrically opposing positions radially on the outer side of the atomizing air spurting holes.

In this case, when a feed tube of a paint cartridge is placed into each feed tube passage hole, its fore end is advanced to fit in the third feed tube passage hole in the projection tube provided on the valve case. Accordingly, paint in the paint cartridge can be discharged from the projection tube to the paint nozzle without leaks to surrounding areas.

Furthermore, the air nozzle can be attached around the paint nozzle easily and simply by the use of a retainer ring. Effluent paint from the paint spurting hole of the paint nozzle can be atomized and atomized paint particles can be adjusted to a desired spray pattern by the atomizing air spurting hole.

BEST MODE FOR CARRYING OUT THE INVENTION

Hereafter, an atomizing coating apparatus is described more particularly by way of its preferred embodiments of the present invention with reference to the accompanying drawings.

Referring first to FIGS. 1 through 14, there is shown a first embodiment of the present invention. In this first embodiment, by way of example the invention is applied to a coating apparatus using aqueous paint which solvent of paint is water and employing water and air as wash fluids.

Figure 1:
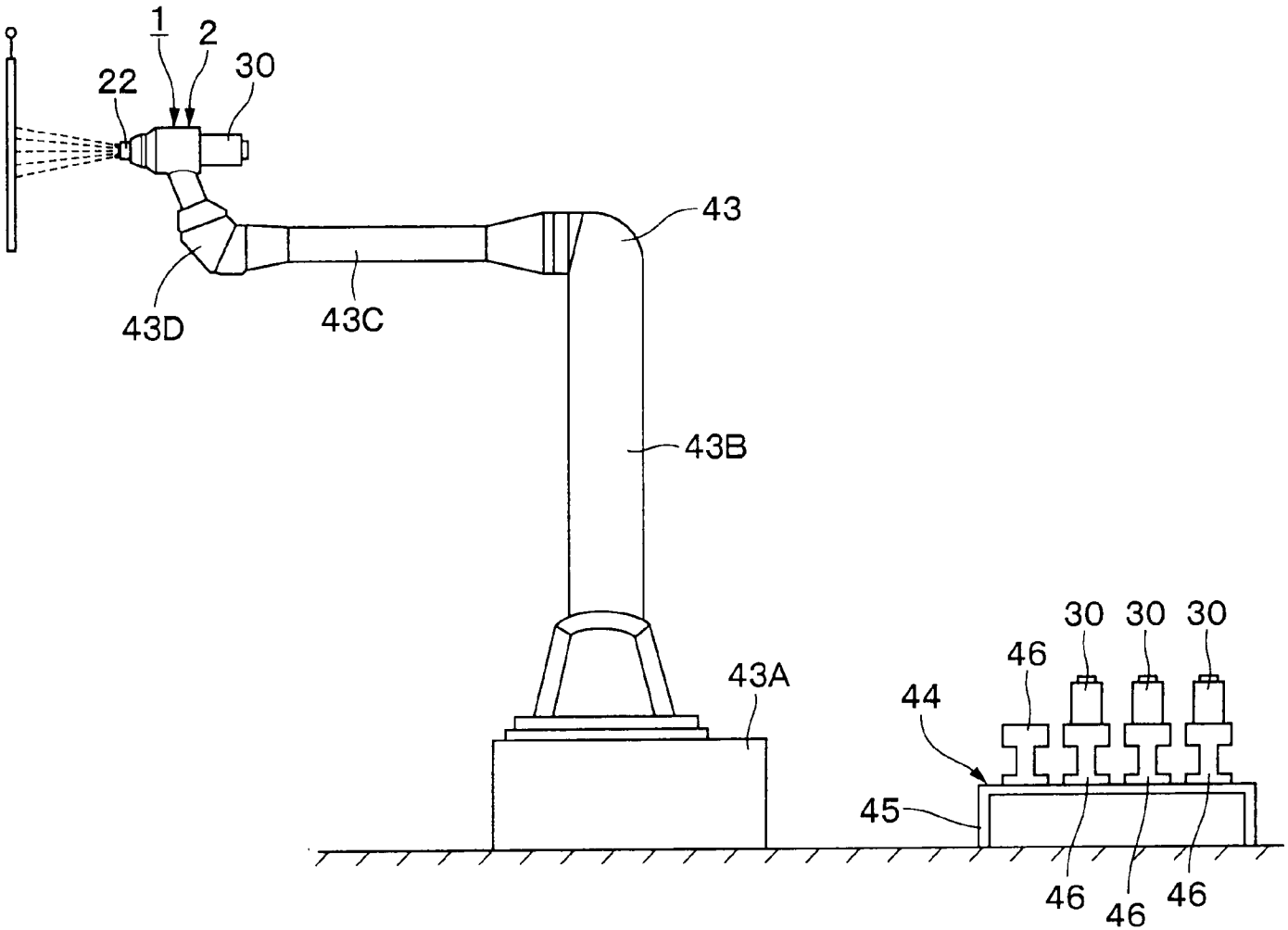
FIG. 1 is a schematic view showing general arrangement of an air atomizing type coating apparatus in a first embodiment of the invention, having a coating apparatus attached on an arm of a coating robot.
Figure 2:
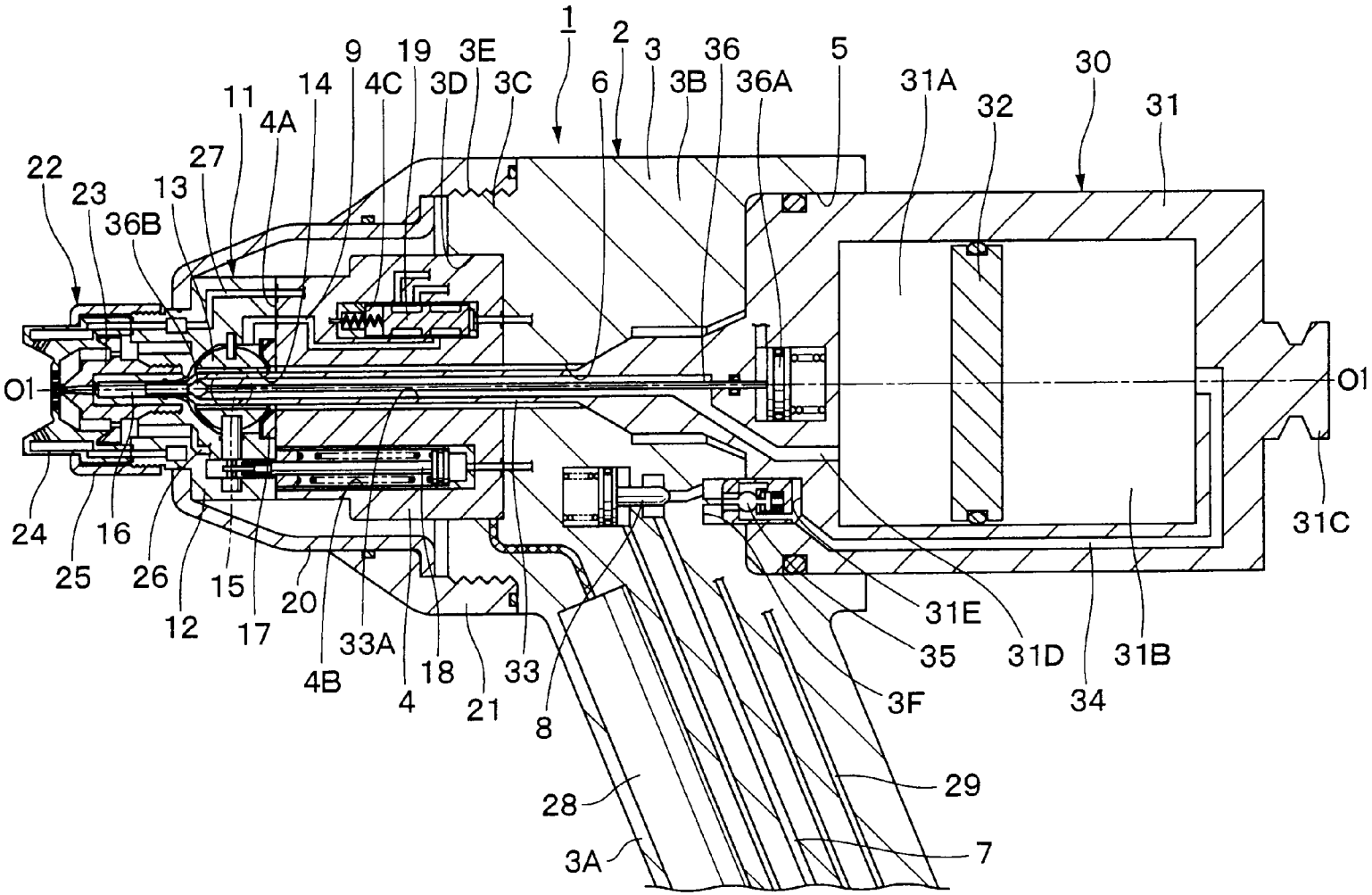
FIG. 2 is a longitudinal sectional view of the air atomizing type coating apparatus of the first embodiment of the present invention.

In FIG. 1, indicated at 1 is an air atomizing type paint coating apparatus (hereinafter simply referred to as "coating apparatus" for brevity) in a first embodiment of the invention. This coating apparatus 1 is of the air spray type which is adapted to atomize and spray paint by means of blasts of atomizing air, and attached on a coating robot 43, which will be described hereinafter. Further, the coating apparatus 1 is interchangeably loaded with one of paint cartridges 30 which will be described hereinafter, and built as an electrostatic coating apparatus of direct charging method which is capable of applying a high voltage directly to circulating paint. As shown in FIG. 2, the coating apparatus 1 is largely constituted by a main body 2, feed tube passage holes 6, 14 and 16, wash fluid passages 9 and 15, a passage change-over mechanism 11, a wash fluid passage change-over valve 19, a cover tube 20, a fastener ring 21, a spray nozzle 22 and a paint cartridge 30, and the like which will be described hereinafter.

Indicated at 2 is a main body which is attached on a coating robot 43. This main body 2 is a base assembly of the coating apparatus 1 and attached on a wrist 43D of the coating robot 43. The main body 2 is largely constituted by a housing 3 and a front body 4, which will be described hereinafter.

Denoted at 3 is a housing of the main body 2, which is composed of a substantially cylindrical holder portion 3A which is attached to the wrist 43D of the coating robot 43, and a head portion 3B which is provided integrally on the top of the holder portion 3A, which will be described hereinafter. The head portion 3B is provided with a cylindrical body which is extended in forward and rearward directions along a longitudinal center axis O1-O1, and formed with a cartridge mount portion 5 in the form of a cylindrical recess at its rear end (at the right end in FIG. 2), which will be described hereinafter.

On the other hand, projected integrally forward from the fore end of the head portion 3B is a short tubular body 3C with a fitting portion 3D on the inner peripheral side for fitting engagement with the front body 4. A screw portion 3E is tapped around the outer periphery of the tubular body 3C for threaded engagement with a fastener ring 21 which will be described hereinafter. Further, a female connector portion 3F is formed in a bottom portion of the cartridge mount portion 5 at the rear end of the head portion 3B for connection with a quick joint 35 of a paint cartridge 30, which will also be described hereinafter.

Indicated at 4 is a front body which is attached to the front side of the housing 3. This front body 4 is formed in the shape of a stepped cylindrical body, and its rear end portion is integrally fitted in the fitting portion 3D of the housing 3. Further, the front body 4 is provided with a passage change-over mechanism mount portion 4A on its front face for connection of a passage change-over mechanism 11 as a passage change-over means mount portion which will be described hereinafter. Part of a first feed tube passage hole 6 is bored centrally and axially through the front body 4 (along the longitudinal center axis O1-O1). Moreover, in the front body 4, a cylinder receptacle hole 4B and a change-over valve receptacle hole 4C are formed around the first feed tube passage hole 6 as a circular space to accommodate an air cylinder 18 and a wash fluid passage change-over valve 19 of the passage change-over mechanism 11, respectively, which will be described hereinafter.

Figure 3:
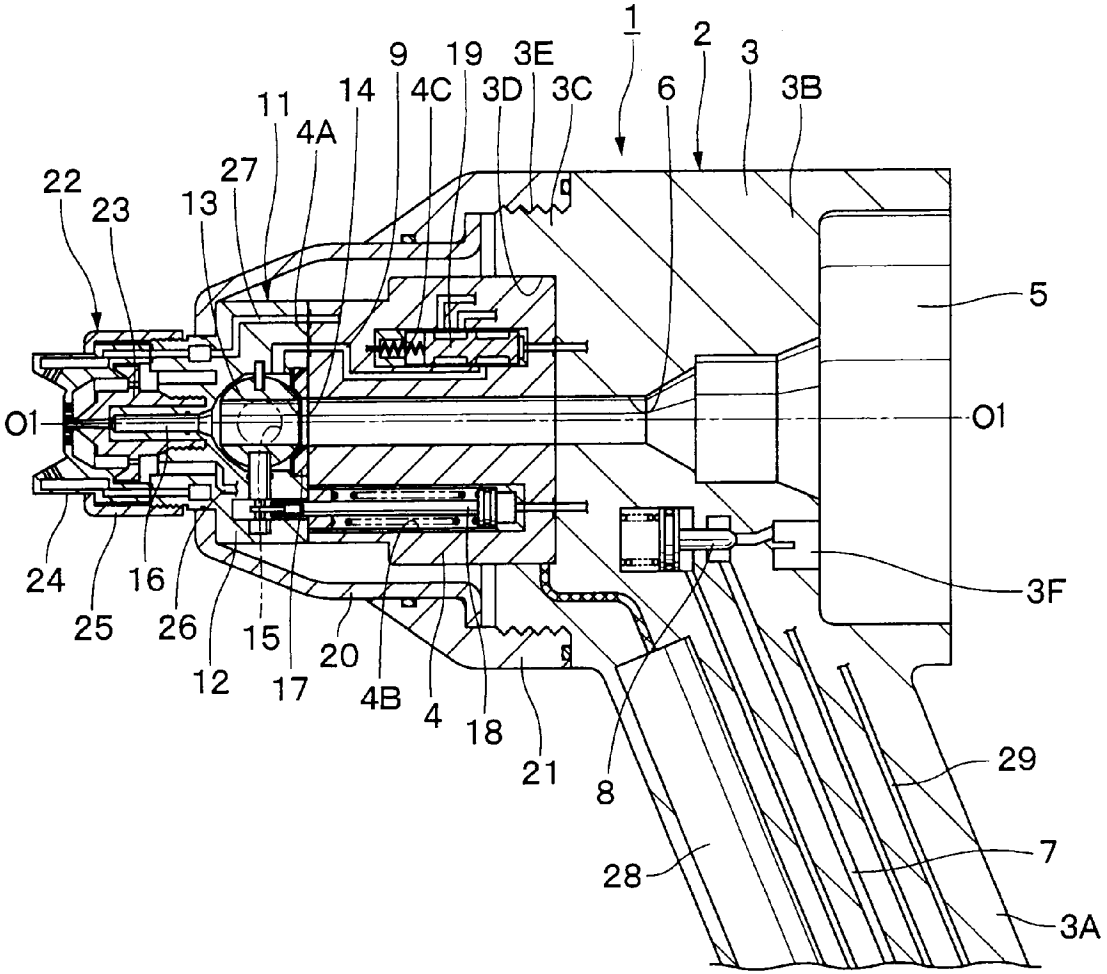
FIG. 3 is a longitudinal sectional view of the same air atomizing type coating apparatus, having a paint cartridge detached and removed therefrom.

Indicated at 5 is a cartridge mount portion which is provided on the main body 2. As shown in FIG. 3, this cartridge mount portion 5 is formed in the shape of a cylindrical recess at the rear end of the head portion 3B of the housing 3. A tank portion 31 of a paint cartridge 30 which will be described hereinafter is detachably set in this cartridge mount portion 5.

Designated at 6 is a first feed tube passage hole which is bored in internally of the main body 2. This feed tube passage hole 6 is to receive a feed tube 33 of a paint cartridge 30, which will be described hereinafter. In this instance, the first feed tube passage hole 6 is extended forward from the housing 3 and axially through the front body 4. The first feed tube passage hole 6 is opened into the cartridge mount portion 5 on the rear side of the housing 3, and into the passage change-over mechanism mount portion 4A of the front body 4 on the front side. Thus, the first feed tube passage hole 6 is formed between the cartridge mount portion 5 on the housing 3 and the passage change-over mechanism mount portion 4A on the front body 4 along the longitudinal center axis O1-O1.

Indicated at 7 is a housing side extruding liquid passage which is provided on the part of the housing 3 of the main body 2. Through this extruding liquid passage 7, an extruding liquid is supplied to an extruding liquid chamber 31B in a tank portion 31 of a paint cartridge 30, which will be described hereinafter. One end of the extruding liquid passage 7 on the side of the housing 3 is connected to an extruding liquid feeder (not shown) while the other end is opened to a bottom portion of the female connector portion 3F which is formed on the housing 3.

Denoted at 8 is an extruding liquid valve which is provided on the head portion 3B of the housing 3. This extruding liquid valve 8 is normally closed to block the extruding liquid passage 7, suspending supply of an extruding liquid to an extruding liquid chamber 31B in a tank portion 31 of a paint cartridge 30, which will be described hereinafter. On the other hand, as soon as a pilot air is applied, the extruding liquid valve 8 is opened to supply an extruding liquid to the extruding liquid chamber 31B.

Figure 6:
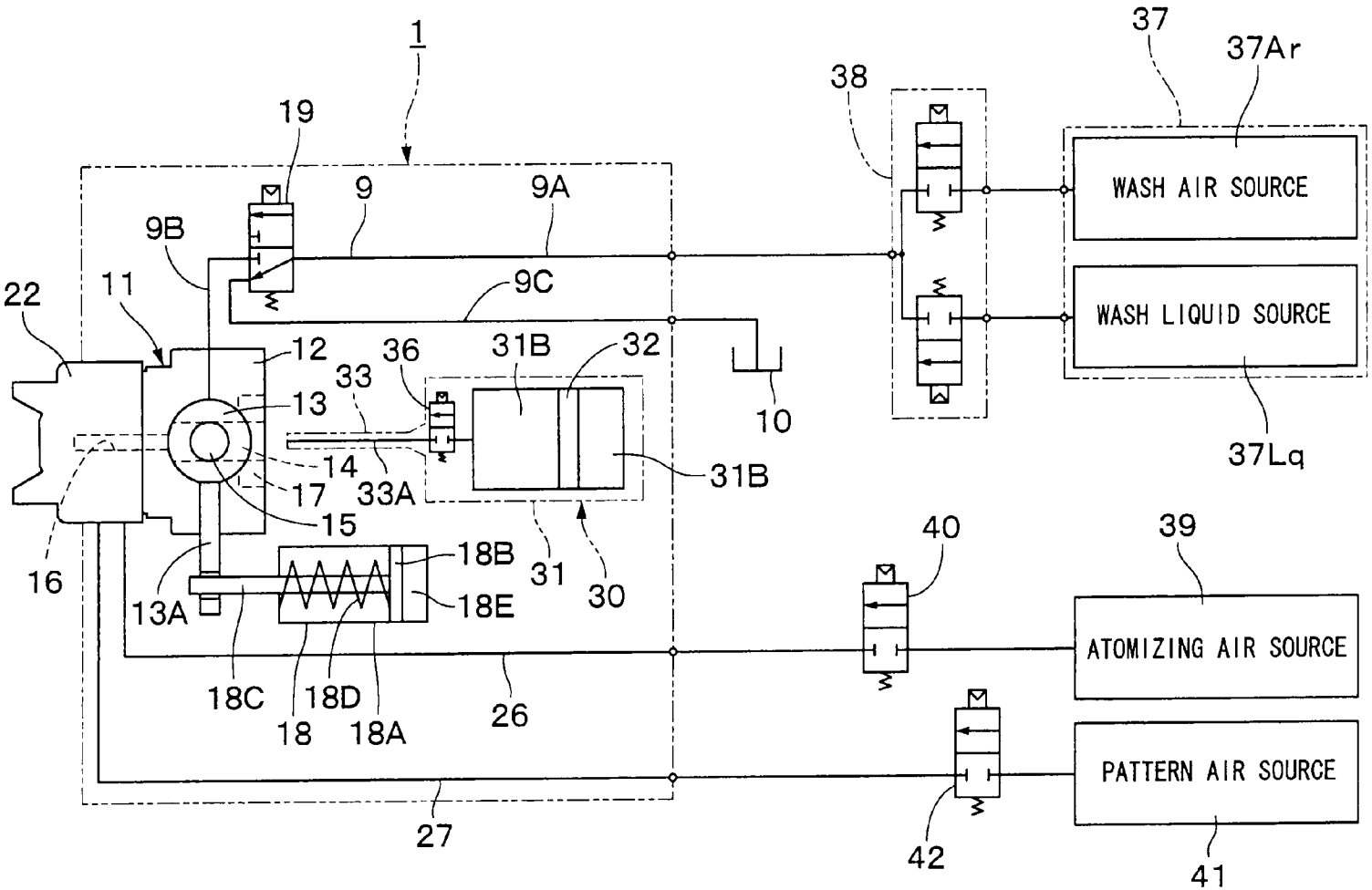
FIG. 6 is a schematic diagram of the air atomizing type coating apparatus in general arrangement according to the first embodiment of the present invention.
Figure 7:
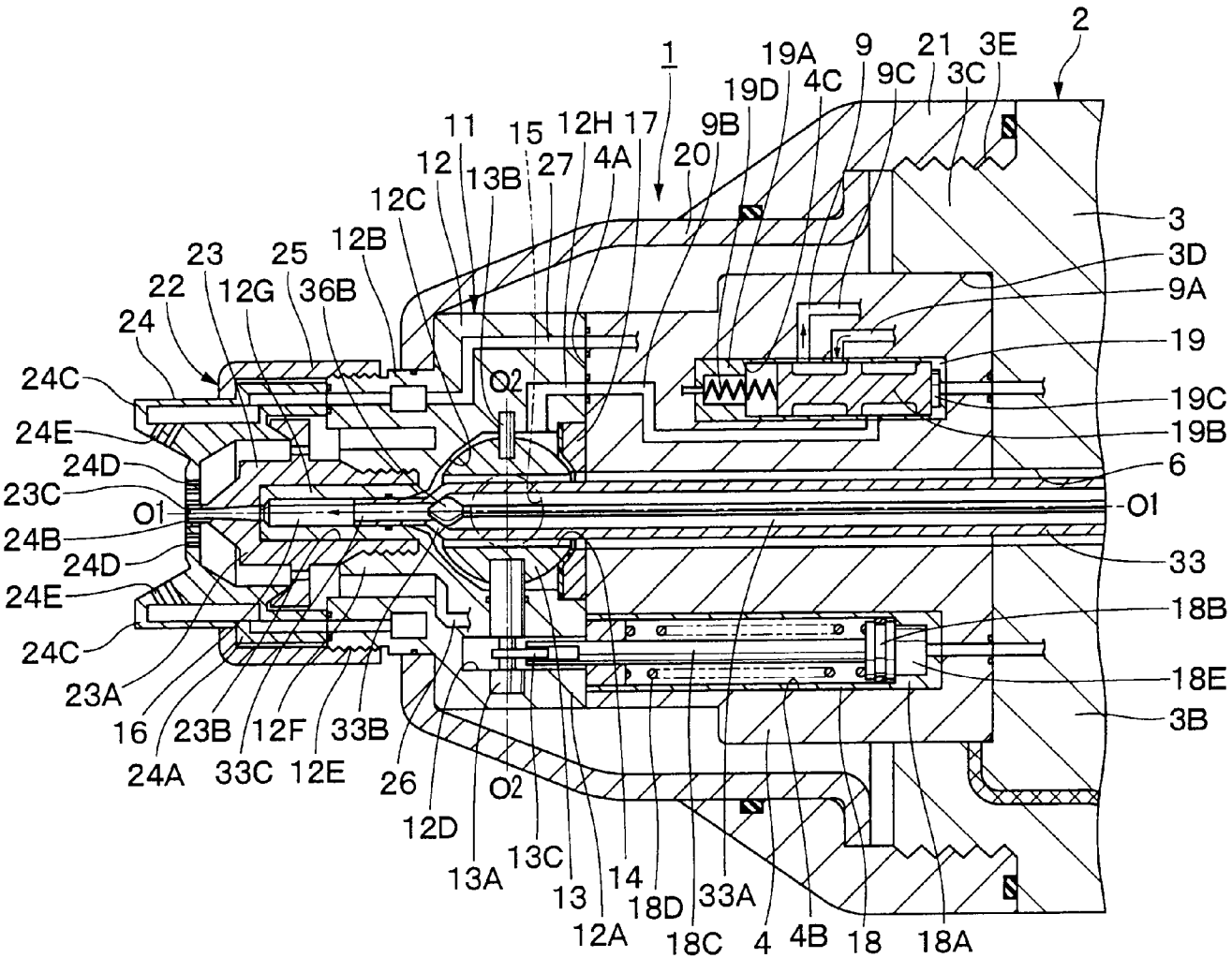
FIG. 7 is an enlarged longitudinal sectional view showing a front portion of the coating apparatus in a coating operation.

Indicated at 9 is a first wash fluid passage which is provided on the main body 2 (see FIGS. 6 and 7). Through this wash fluid passage 9, wash liquids such as water and wash air are supplied at the time of washing off paint which has deposited on a spray nozzle 22 in the manner as described hereinafter. In this instance, as shown in FIG. 6, the first wash fluid passage 9 is connected to a wash fluid source device 37 through a wash fluid selector valve 38, which will also be described hereinafter. As shown in FIG. 7, the first wash fluid passage 9 is composed of an upstream supply passage 9A for circulation of a wash fluid from the wash fluid selector valve 38 toward a wash fluid passage change-over valve 19, a downstream supply passage 9B for circulation of a wash fluid from the wash fluid passage change-over valve 19 toward a valve case 12 of the passage change-over mechanism 11, and a discharge passage 9C for discharging a wash fluid from the wash fluid passage change-over valve 9 toward an external waste liquid tank 10.

Now, following is a description on the passage change-over mechanism 11 which is provided on the front side of the main body 2 to serve as a passage change-over means.

Indicated at 11 is a passage change-over mechanism which is adopted in the present embodiment as a passage change-over means. When in a coating position (the position shown in FIGS. 5 and 7) which will be described hereinafter, the passage change-over mechanism 11 shifts the first feed tube passage hole 6 into a position for communication with a second feed tube passage hole 14, and, when in a washing position (the position of FIG. 8), shifts the first wash fluid passage 9 into a position for communication with a second wash fluid passage 15. Further, the passage change-over mechanism 11 is detachably attached to the side of the main body 2 by means of the cover tube 20 and fastener ring 21, which will be described hereinafter. The passage change-over mechanism 11 is largely constituted by a valve case 12, a ball valve body 13, valve seat member 17 and an air cylinder 18, as described below.

Figure 5:
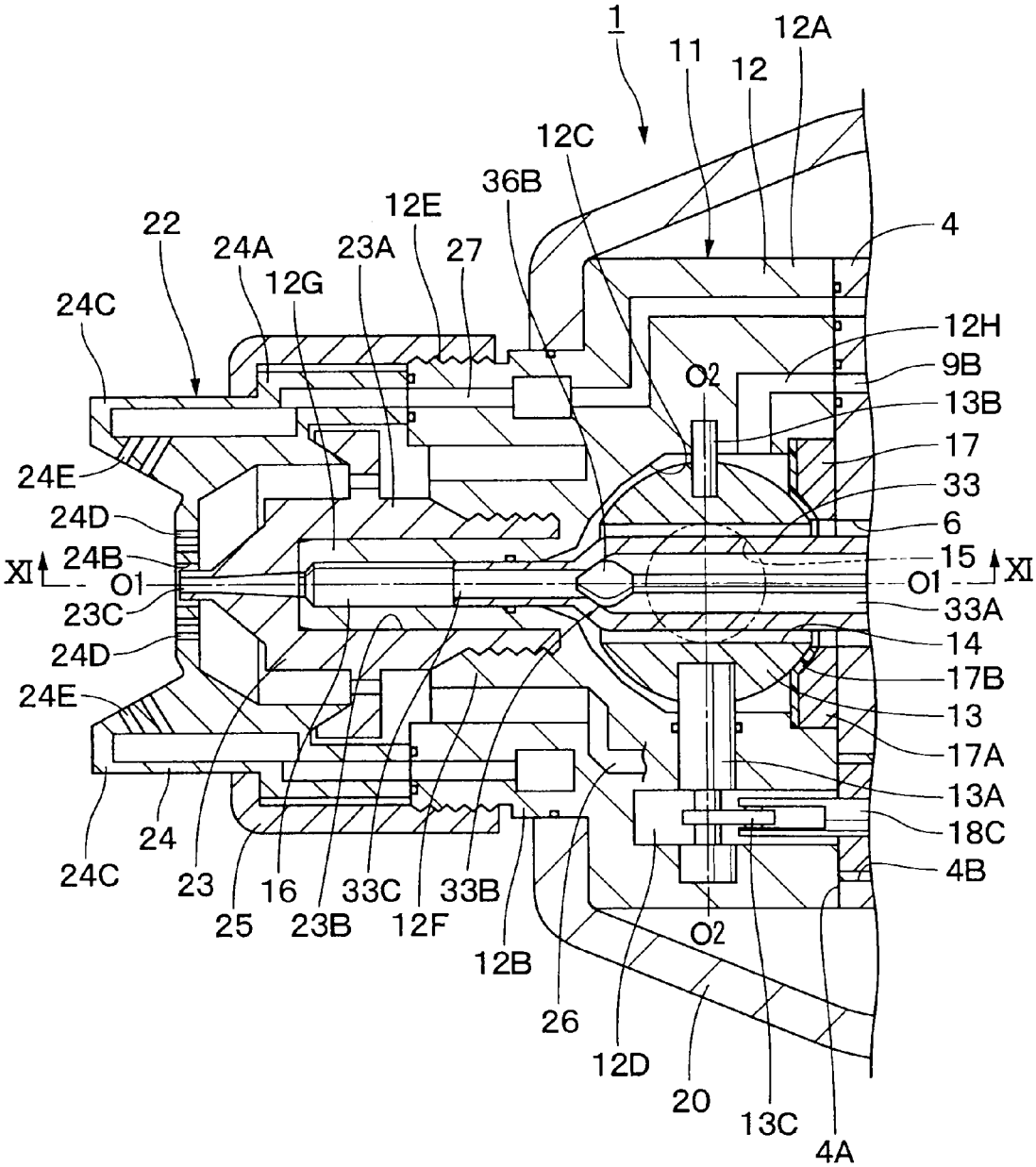
FIG. 5 is an enlarged longitudinal sectional view showing a passage change-over mechanism and a spray nozzle in FIG. 2.

Indicated at 12 is a valve case of the passage change-over mechanism 11 which is attached to the passage change-over mechanism mount portion 4A of the front body 4. The valve case 12 is formed in the shape of a stepped cylindrical body in alignment with the center axis O1-O1. More specifically, as shown in FIG. 5, the valve case 12 is in the form of a stepped cylindrical body having a large diameter tubular portion 12A on the rear side and a small diameter tubular portion 12B on the front side. A valve body receptacle hole 12C with a spherical bottom portion is formed centrally in the large diameter tubular portion 12A, and bore with a rod reciprocating hole 12D in an outer peripheral portion against the cylinder receptacle hole 4B on the front body 4.

Further, a screw portion 12E is tapped around the outer periphery of the small diameter tubular portion 12B on the front side for threaded engagement with a retainer ring 25, which will be described hereinafter. On the other hand, an internally tapped inner screw portion 12F of a small diameter is provided on the inner peripheral side of the small diameter tubular portion 12B for threaded engagement with a base end portion of a paint nozzle 23, which will be described hereinafter.

Projected forward within the inner screw portion 12F of the valve case 12 is an projection tube 12G axially in alignment with a second feed tube passage hole 14 which will be described hereinafter. This projection tube 12G plays a role of spouting paint toward a paint nozzle 23, which will be described hereinafter, and for this purpose a third feed tube passage hole 16 is formed internally of the projection tube 12G.

Further, a fluid passage 12H is formed internally of the valve case 12 to function as part of a first wash fluid passage 9. This fluid passage 12H is in communication with a downstream supply passage 9B of the first wash fluid passage 9 and the valve body receptacle hole 12C at the opposite ends.

Figure 9:
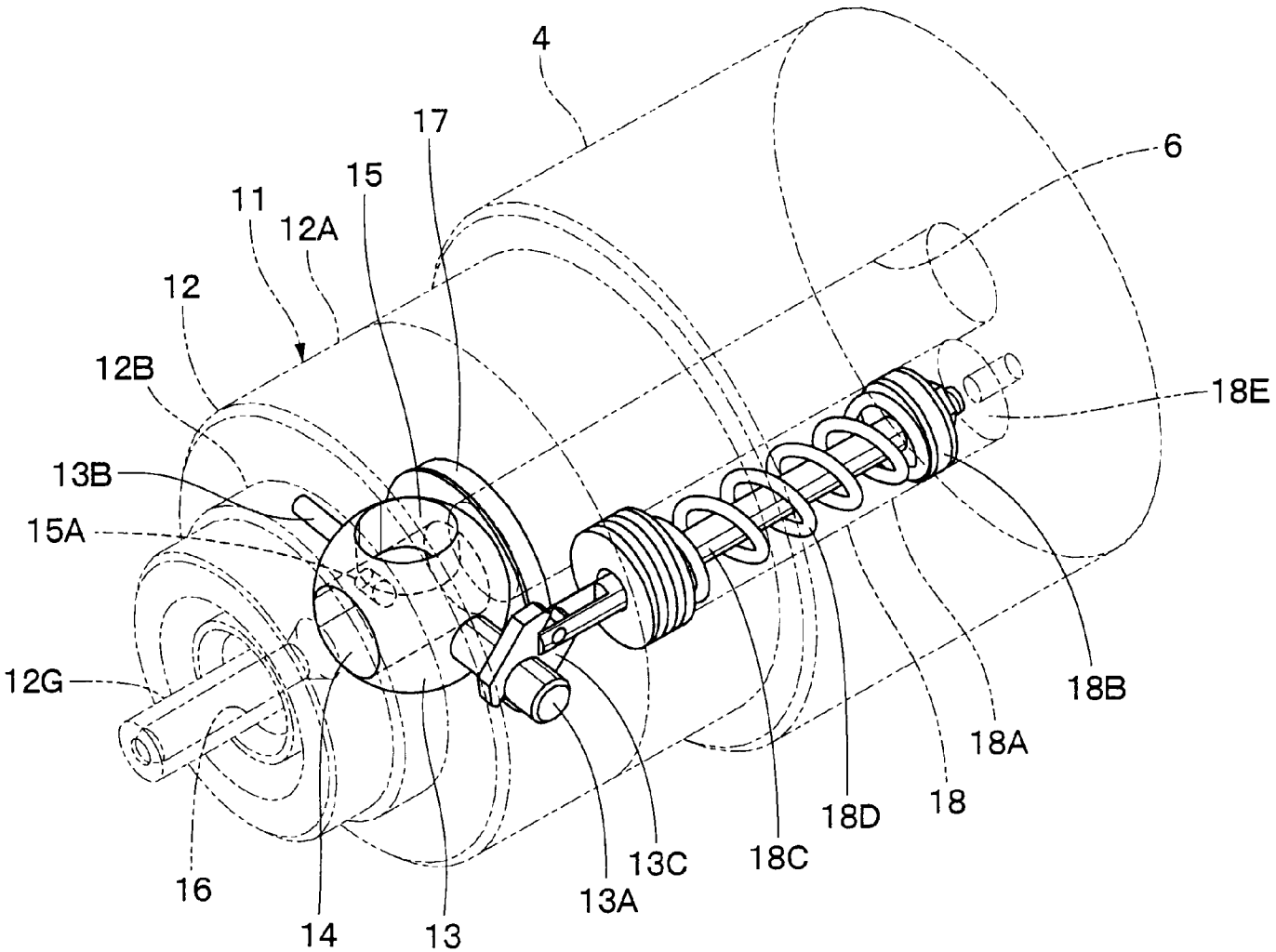
FIG. 9 is a schematic perspective view showing a ball valve body switched to a coating position by an air cylinder.
Figure 10:
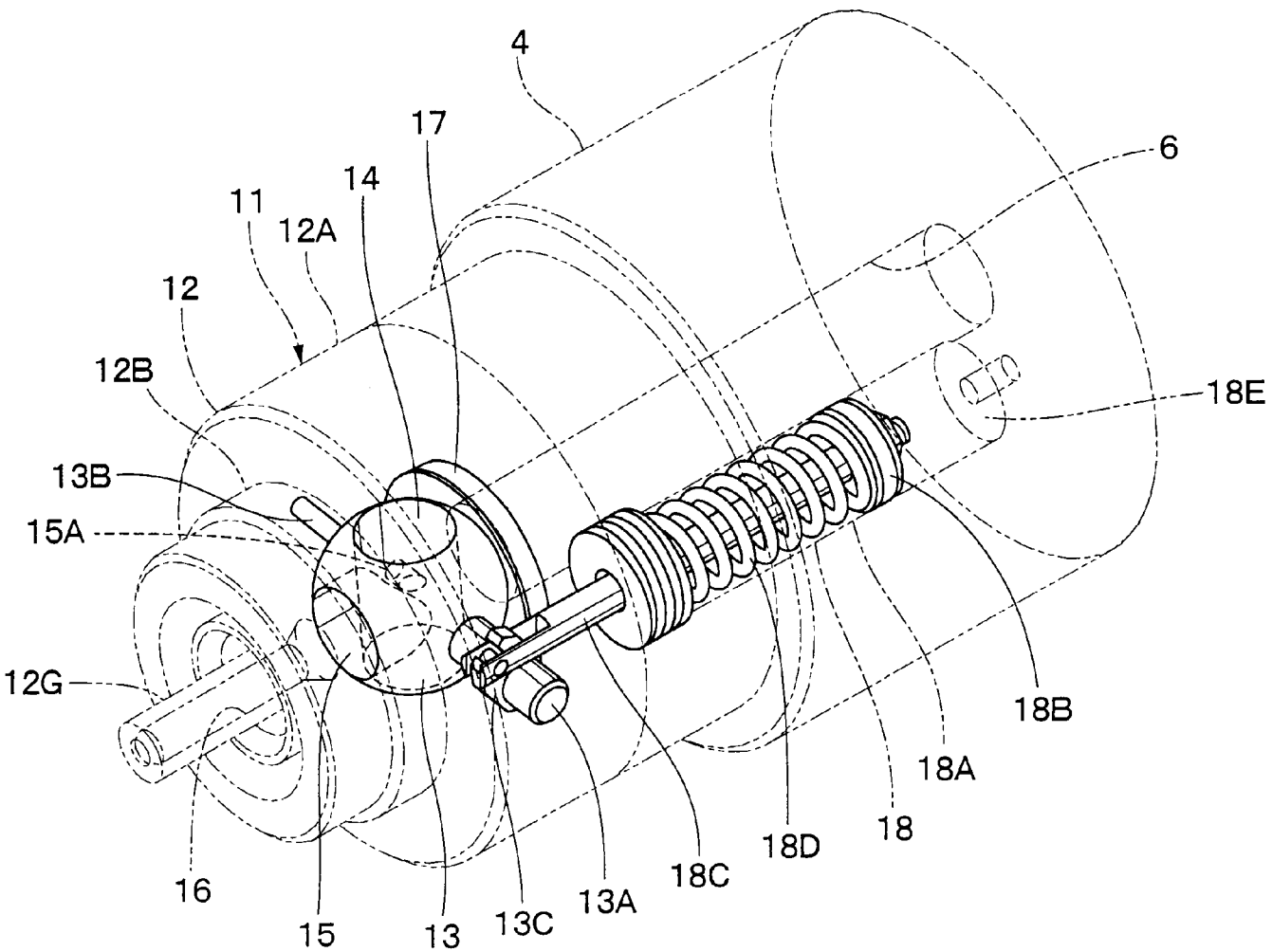
FIG. 10 is a schematic perspective view showing a ball valve body switched to a washing position by the air cylinder.

Indicated at 13 is a ball valve body which is rotatably received in the valve body receptacle hole 12C in the valve case 12. As shown in FIGS. 9 and 10, this ball valve body 13 is formed in a spherical shape. Further, as shown in FIG. 5, the ball valve body 13 is integrally provided with a large diameter shaft 13A and a small diameter shaft 13B along a center axis O2-O2 passing through the center of the ball valve body 13 positioned at the radially opposite side. The large diameter shaft 13A is located on the side of the rod reciprocating hole 12D, while the small diameter shaft 13B is located on the side of the downstream supply passage 9B of the first wash fluid passage 9, namely, on the side of the fluid passage 12H.

Namely, the large and small diameter shafts 13A and 13B are rotatably supported within the valve case 12 for rotation about the center axis O2-O2 which is disposed perpendicularly to the longitudinal axis O1-O1. A lever 13C which is attached to a distal end portion of the large diameter shaft 13A within the rod reciprocating hole 12D is connected to a rod 18C which will be described hereinafter. Provided across the ball valve body 13 are a second feed tube passage hole 14 and a second wash fluid passage 15, as described below.

Indicated at 14 is a second feed tube passage hole which is provided across the ball valve body 13. This second feed tube passage hole 14 is bored radially through the center of the ball valve body 13 in perpendicularly intersecting relation with the center axis O2-O2. When the ball valve body 13 is switched to a coating position of FIG. 11, the second feed tube passage hole 14 is shifted to a coaxially communicating position relative to the first feed tube passage hole 6. In this switched position, a feed tube 33 of a paint cartridge 30 can be inserted into the first and second feed tube passage holes 6 and 14 until its fore end is placed and received in a third feed tube passage hole 16, which will be described hereinafter.

Indicated at 15 is a second wash fluid passage which is bored across the ball valve body 13. This wash fluid passage 15 is communicated with the second feed tube passage hole 14 at a center position of the ball valve body 13. Further, the second wash fluid passage 15 is in the form of a bottomed bore which is orthogonal to both of the center axis O2-O2 and the second feed tube passage hole 14 and has a length approximately corresponding to the radius of the ball valve body 13. Namely, the second wash fluid passage 15 is extended in a radial direction in such a way as to intersect with the second feed tube passage hole 14 in T-shape.

Figure 12:
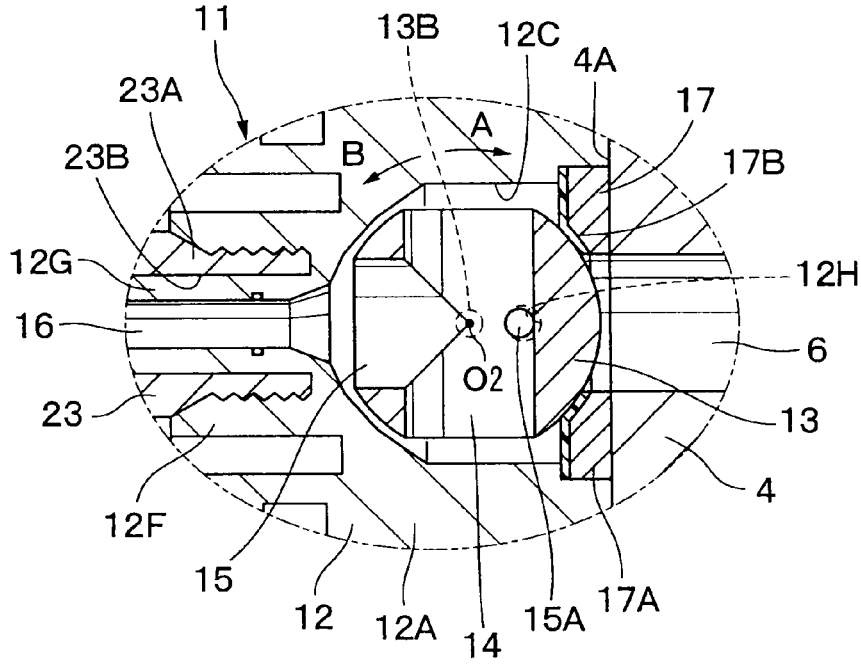
FIG. 12 is an enlarged longitudinal sectional view in the same position as FIG. 11, showing the ball valve body which has been switched to a washing position.

Further, the second wash fluid passage 15 is provided with a communication passage 15A in the ball valve body 13, for communication with the downstream supply passage 9B of the first wash fluid passage 9. As shown in FIG. 12, when the ball valve body 13 is turned to a washing position, this communication passage 15A is shifted to a substantially coaxially aligned communicating position relative to a fluid passage 12H of the valve case 12 which is formed as part of the downstream supply passage 9B of the first wash fluid passage 9. As a consequence, by way of the communication passage 15A, a wash fluid which is supplied from the first wash fluid passage 9 can be led into the second wash fluid passage 15 without killing its torrential power.

Indicated at 16 is a third feed tube passage hole which is provided internally of the projection tube 12G of the valve case 12. As shown in FIG. 5, the third feed tube passage hole 16 is located coaxially with the first feed tube passage hole 6 (located on the longitudinal center axis O1-O1). A fore end portion of the feed tube 33 of a paint cartridge 30 is fitted liquid tight in the third feed tube passage hole 16.

Figure 13:
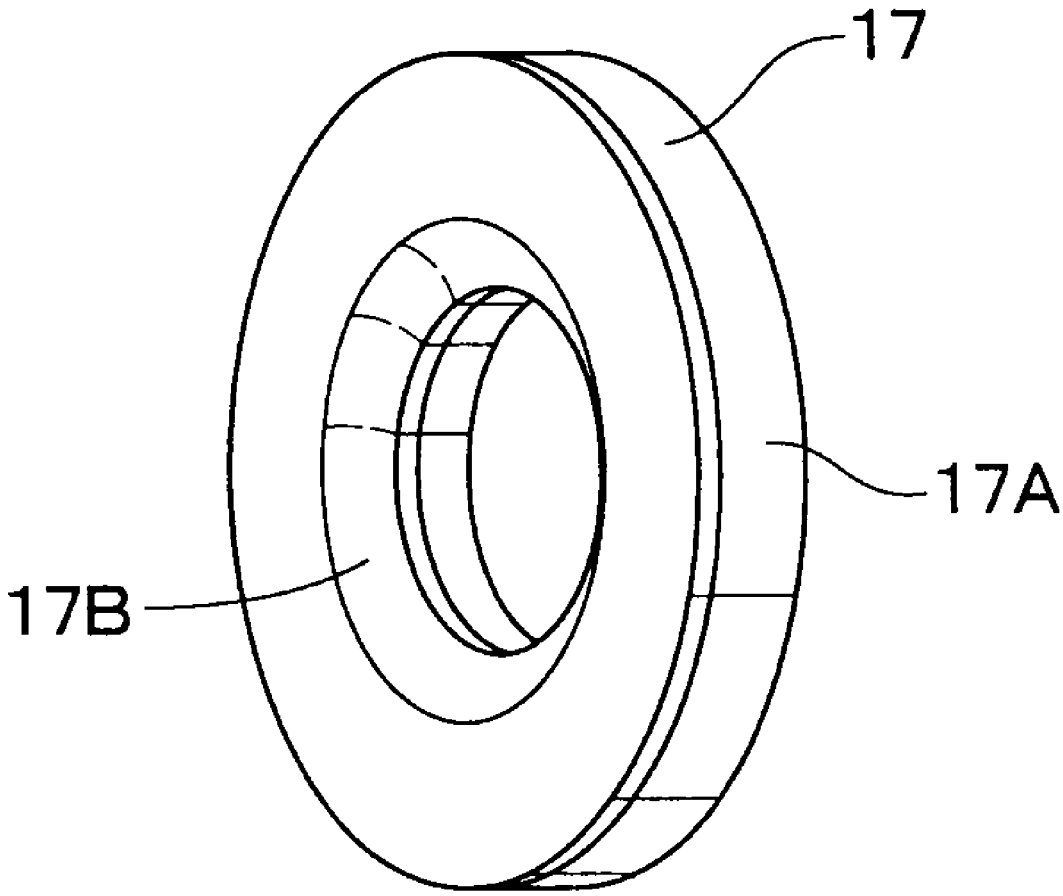
FIG. 13 is a schematic perspective view showing a valve seat member alone in an enlarged scale.

Denoted at 17 is an annular valve seat member which is provided at a rear open side of the valve body receptacle hole 12C of the valve case 12. This valve seat member 17 plays a role of preventing a wash fluid flowing out from the first wash fluid passage 9 toward the first feed tube passage hole 6. Further, as shown in FIG. 13, the valve seat member 17 is formed of a base plate member 17A of a metallic material which is located on the side of the front body 4, and a sheet-like seal member 17B, for example, of a resilient, macromolecular synthetic resin material, which is securely and integrally attached on the front side of the base plate member 17A. The valve seat member 17 is located around the first feed tube passage hole 6, hermetically sealing outer surfaces of the ball valve body 13 with a concave inner peripheral portions of the seal member 17B.

Figure 8:
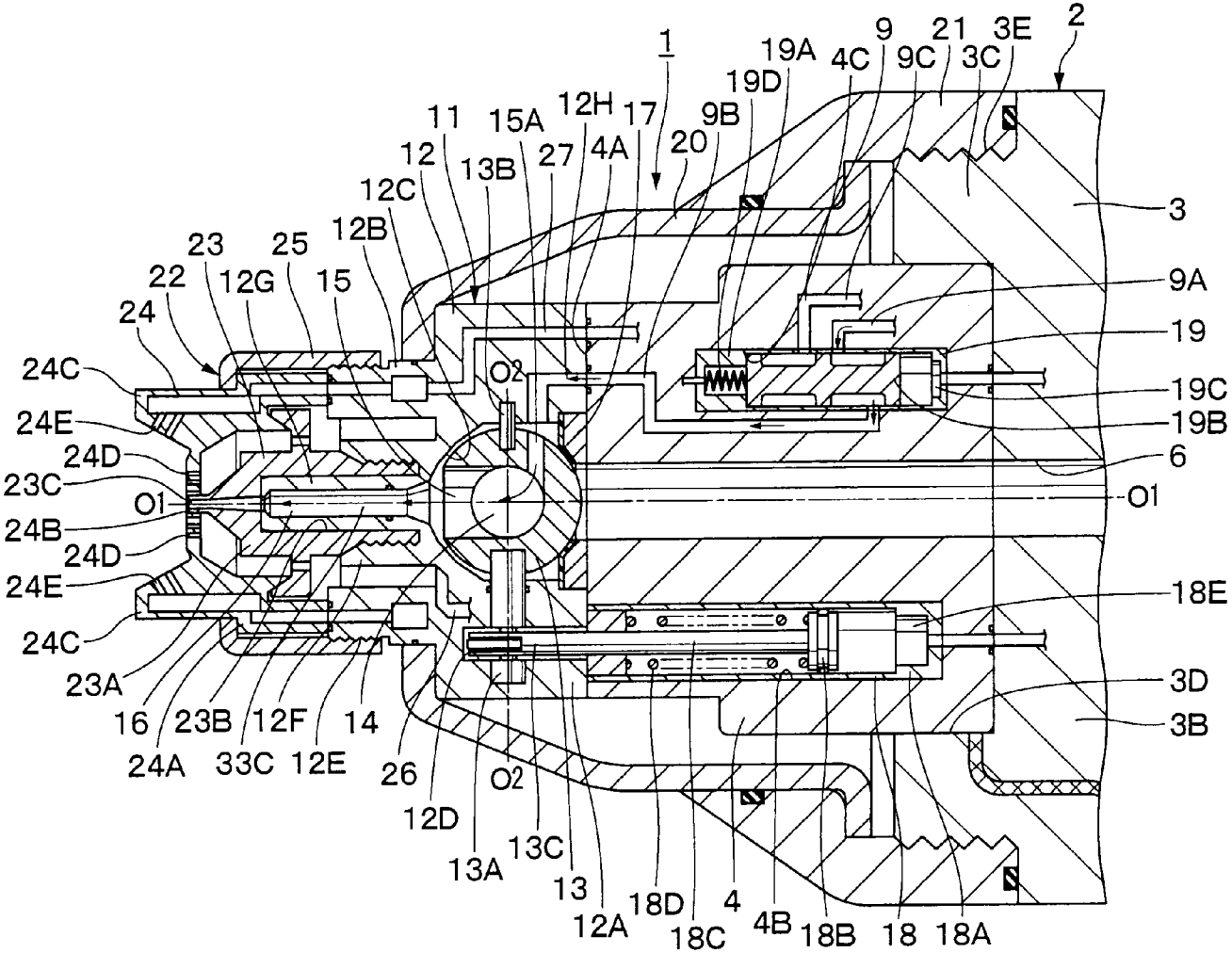
FIG. 8 is an enlarged longitudinal sectional view showing a front portion of the coating apparatus in a washing operation.

Indicated at 18 is an air cylinder which is provided on the main body 2 as an actuator of the passage change-over mechanism 11. This air cylinder 18 is adapted to turn the ball valve body 13 substantially through 90 degrees in step with its reciprocating movement. As shown in FIGS. 7 and 8, the air cylinder 18 is incorporated into a cylinder receptacle hole 4B on the front body 4. Further, the air cylinder 18 is largely constituted by a cylinder case 18A which is fitted in the cylinder receptacle hole 4B, a piston 18B which is axially slidably fitted in the cylinder case 18A, a rod 18C which is attached to the piston 18B at its base end and projected out of the cylinder case 18A and connected to a lever 13C of the ball valve body 13 at its fore end, and a spring member 18D which is adapted to urge the rod 18C in a contracting direction through the piston 18B.

Figure 11:
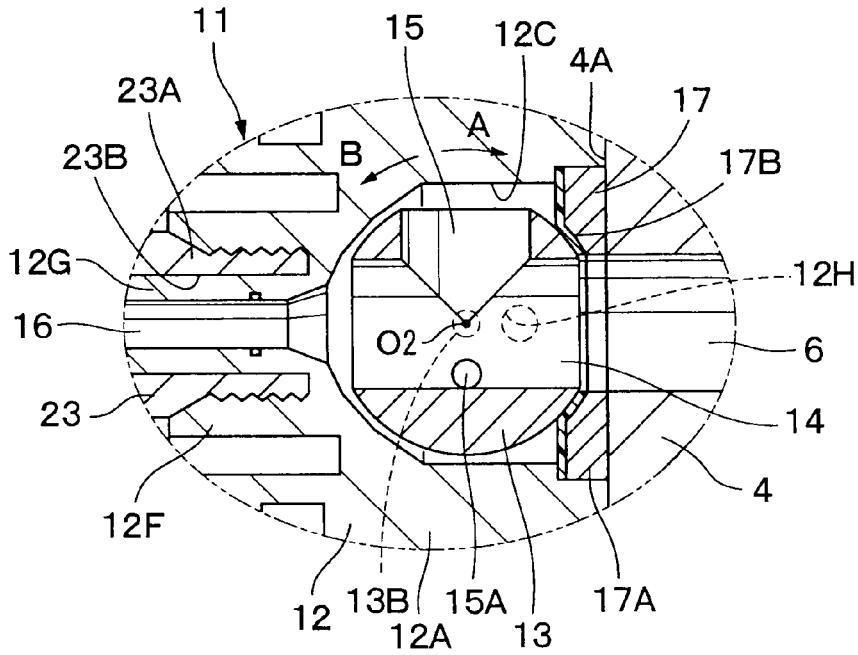
FIG. 11 is an enlarged longitudinal sectional view taken in the direction of arrows XI-XI of FIG. 5, showing the ball valve body which has been switched to a coating position.

Normally, the rod 18C of the air cylinder 18 is normally held in a maximally contracted state by the action of the spring member 18D, with the ball valve body 13 turned in the direction of arrow A to take a coating position as shown in FIG. 11. On the other hand, as soon as air is supplied to an air chamber 18E to expand the rod 18C, the ball valve body 13 is turned in the direction of arrow B to take a washing position as shown in FIG. 12.

Thus, the passage change-over mechanism 11 is so arranged that the ball valve body 13 is turned in the direction of arrow A by the air cylinder 18 to take a coating position when a paint cartridge 30 is attached to the housing 3, bringing the second feed tube passage hole 14 into a coaxially aligned communicating position relative to the first feed tube passage hole 6 and the third feed tube passage hole 16. In this position, a feed tube 33 of a paint cartridge 30 can be inserted into the respective feed tube passage holes 6, 14 and 16 upon attaching the paint cartridge 30 to the housing 3.

On the other hand, when starting a washing operation to wash away paint which has deposited on a spray nozzle 22 through the painting operation, which will be described hereinafter, the ball valve body 13 is turned in the direction of arrow B, bringing the second wash fluid passage 15 into a coaxially aligned communicating position relative to the third feed tube passage hole 16. Moreover, bringing communicating passage of the second wash fluid passage 15 into nearly coaxially aligned communicating position relative to the downstream supply passage 9B of the first wash fluid passage 9. In this position, a wash fluid which is delivered through the respective wash fluid passages 15, 19 can be supplied to the third feed tube passage hole 16 and the spray nozzle 22, and the like.

Indicated at 19 is a wash fluid passage change-over valve which is provided in a change-over valve receptacle hole 4C on the front body 4 in the course of the first wash fluid passage 9. By this wash fluid passage change-over valve 19, a wash fluid which is supplied from the upstream supply passage 9A is switched either to the downstream supply passage 9B or to the discharge passage 9C. The wash fluid passage change-over valve 19 is largely constituted by a tubular case 19A which is fitted in the change-over valve receptacle hole 4C, a spool 19B which is axially slidably received in the tubular case 19A, and a valve spring 19D which is adapted to bias the spool 19B toward a pilot air chamber 19C.

Further, at the time of washing a spray nozzle 22, pilot air is supplied to the pilot air chamber 19C to displace the spool 19B of the wash fluid passage change-over valve 19 in a forward direction against the action of the valve spring 19D, connecting the upstream supply passage 9A and the downstream supply passage 9B of the first wash fluid passage 9 to supply a wash liquid and wash air to the spray nozzle 22 via the passage change-over mechanism 11 for cleaning the spray nozzle 22.

In this instance, in a case where the wash liquid is a liquid of low volatility like water and the like, there may arise a situation such that residues of the wash fluid cannot be removed (dried out) within a predetermined time length of a washing operation. Existence of such lingering wash liquid residues in the first wash fluid passage 9 can cause leakage of a high voltage which is applied to paint for direct charging purposes and the high voltage run down to the earth ground along wash liquid residues.

In order to cope with this problem, in a case water and the like is used as a wash liquid, a supply of pilot air against the wash fluid passage change-over valve 19 is cut off and the spool 19B is displaced in a rearward direction by the valve spring 19D after the completion of washing the spray nozzle 22. Thus, wash air supplied from the upstream supply passage 9A wash out through the discharge passage 9C to the side of waste liquid tank 10. By so doing, wash air is allowed to continually flow through the first wash liquid passage 9 and purge (dry off) the wash fluid in an assured manner during a next paint cartridge 30 mounting operation and following painting operation after a completion of washing operation.

Indicated at 20 is a cover tube which is arranged to enshroud the outer peripheral side of the passage change-over mechanism 11 and the front body 4. This cover tube 20 is engaged with the large diameter tubular portion 12A of the valve case 12 at its fore end, while the rear end of the cover tube 20 is located in the vicinity of the tubular body 3C of the housing 3. Indicated at 21 is a fastener ring which is fitted in such a way as to circumvent the outer peripheral side of a rear end portion of the cover tube 20. The fastener ring 21 is threaded onto the screw portion 3E tapped around the tubular body 3C of the housing 3 to connect the passage change-over mechanism 11 fixedly and detachably to the passage change-over mechanism mount portion 4A of the front body 4 in cooperation with the cover tube 20. Thus, the cover tube 20 and the fastener ring 21 of the present invention are shown as particular examples of cover means for attaching the passage change-over mechanism 11 detachably to the main body 2.

Now, described below is an air atomizing type spray nozzle 22 which is attached on the front side of the passage change-over mechanism 11 as an atomizing means.

Namely, indicated at 22 is an air atomizing type spray nozzle as an atomizing means which is attached to the front side of the passage change-over mechanism 11. This spray nozzle 22 has functions of atomizing paint and spraying atomized paint particles in a desired spray pattern. More particularly, the spray nozzle 22 is constituted by a paint nozzle 23 which spouts paint, and an air nozzle 24 to spurt atomized air forward for atomizing paint which is discharged from the paint nozzle 23, in the manner as described below.

More specifically, indicated at 23 is a paint nozzle which is attached to the front side of the valve case 12 of the passage change-over mechanism 11. This paint nozzle 23 plays a role to spout paint which is supplied from a paint cartridge 30, which will be described hereinafter. The paint nozzle 23 is constituted by a paint nozzle body 23A in the shape of a stepped tube having a base end portion thereof threaded into the inner screw portion 12F in the valve case 12, a projection tube receptacle hole 23B which is formed internally in a rear side of the paint nozzle body 23A for insertion of the projection tube 12G of the valve case 12, and a paint spurting hole 23C which is formed in a front side of the paint nozzle body 23A for spouting paint which is delivered to the projection tube receptacle hole 23B.

Indicated at 24 is an air nozzle which is attached to the front side of the valve case 12 of the passage change-over mechanism 11 in such a way as to enshroud the paint nozzle 23. For atomization of effluent paint from the paint spurting hole 23C of the paint nozzle 23, atomizing air is spurted out from this air nozzle 24 along with spray pattern control air which forms spray pattern. By the use of a retainer ring 25 which will be described hereinafter, the air nozzle 24 is detachably attached on the small diameter tubular portion 12B of the valve case 12.

Further, the air nozzle 24 is constituted by an air nozzle body 24A which is formed in the shape of a bottomed tube arranged to cover outer peripheral side and front side of the paint nozzle body 23A and is attached on the valve case 12 of the passage change-over mechanism 11 by means of a retainer ring 25, a center opening 24B which is opened at the front face center portion of the air nozzle body 24A where a paint spurting hole 23C of the paint nozzle 23 is projected, a couple of horn portions 24C which are projected forward on the front side of the air nozzle body 24A at diametrically opposite positions, a plural number of atomizing air spurting holes 24D bored around the center opening 24B in front of the air nozzle body 24A, and a plural number of pattern air spurting holes 24E which are positioned on the outer side than the atomizing air spurting holes 24D in a radial direction and bored obliquely in opposing positions on respective to the horn portions 24C.

In this instance, effluent paint from the paint spurting holes 23C of the paint nozzle 23 is atomized by atomizing air which is spurted out through the center opening 24B and atomizing air spurting holes 24D of the air nozzle 24. At the same time, a paint spray pattern is adjusted to an elliptical shape, for example, by pattern control air which is spurted out through the pattern air spurting holes 24E toward atomizing paint.

Indicated at 25 is a retainer ring which is fitted around the outer periphery of the air nozzle 24. This retainer ring 25 which is fitted on the outer periphery of the air nozzle body 24A is threaded onto a screw portion 12E tapped around the outer periphery of the small diameter tubular portion 12B of the valve case 12 to detachably attach the air nozzle 24 to the valve case 12.

Designated at 26 is an atomizing air passage which is provided in communication with the respective atomizing air spurting holes 24D of the air nozzle 24. This atomizing air passage 26 is connected to an atomizing air source 39 through an atomizing air valve 40, which will be described hereinafter. Further, indicated at 27 is a pattern air passage which is provided in communication with the respective pattern air spurting holes 24E of the air nozzle 24. This pattern air passage 27 is connected to a pattern air source 41 through a pattern air valve 42, which will be described hereinafter.

Indicated at 28 is a high voltage generator which is installed in the holder portion 3A of the housing 3. For example, this high voltage generator 28 is constituted by a Cockcroft circuit which is adapted to elevate a source voltage from a power source (not shown) to a voltage of −30 to −150 kV. The output side of the high voltage generator 28 is electrically connected, for example, to the front body 4 to apply a high voltage directly to paint through the passage change-over mechanism 11 from the front body 4.

Indicated at 29 are a plural number of air passages which are provided in the housing 3 in communication with a control air source (not shown). These air passages 29 are provided to deliver pilot air to drive the air cylinder 18, wash fluid passage change-over valve 19 and paint valve 36. However, in the particular embodiment shown, a single air passage 29 is shown as a representative.

Now, given below is a description on a paint cartridge 30 which is detachably attached to the main body 2, with reference to FIG. 4.

Namely, denoted at 30 is a paint cartridge to be detachably attached on the cartridge mount portion 5 of the main body 2 (FIG. 1). A plural number of paint cartridges 30 are provided correspondingly for different paint colors, i.e., a color-a, a color-b through a color-n. One paint cartridge 30 is selected from replenishing stools 46 at a paint replenishing unit 44, which will be described hereinafter. As shown in FIG. 4, each paint cartridge 30 is largely constituted by a tank portion 31, a piston 32, a feed tube 33 and a paint valve 36 and the like which will be described hereinafter.

Indicated at 31 is a tank portion of the paint cartridge 30, in the form of a cylindrical container which is closed at opposite axial ends. A piston 32 is axially displaceably fitted in the tank portion 31 in such a way as to define a paint chamber 31A in the front side and an extruding liquid chamber 31B in the rear side of the tank portion 31.

A grip portion 31C to be grasped in a cartridge changing operation is projected on the rear side of the tank portion 31. On the other hand, a paint passage 31D is provided in the front side of the tank portion 31 in communication with a paint supply passage 33A of a feed tube 33, which will be described hereinafter. Further, a joint mount portion 31E is provided in the front side of the tank portion 31 to accommodate a quick joint 35, which will also be described hereinafter.

Denoted at 33 is a feed tube which is extended axially forward on the front side of the tank portion 31. This feed tube 33 is provided to discharge a paint which is replenished in the paint chamber 31A of the tank portion 31 toward the paint nozzle 23. A paint supply passage 33A is provided internally through the feed tube 33 in communication with the paint chamber 31A, and a valve seat portion 33B is provided at the fore distal end of the feed tube 33 in a radial diameter gradually reducing state as shown in FIG. 5. A spout portion 33C of a reduced diameter is provided at the fore distal end of the feed tube 33.

When the ball valve body 13 of the passage change-over mechanism 11 is switched to the coating position shown in FIGS. 5 and 7, the feed tube 33 is communicated with the first and second feed tube passage holes 6 and 14, and the spout portion 33C at the fore distal end is fitted liquid tight in the third feed tube passage hole 16.

Figure 4:
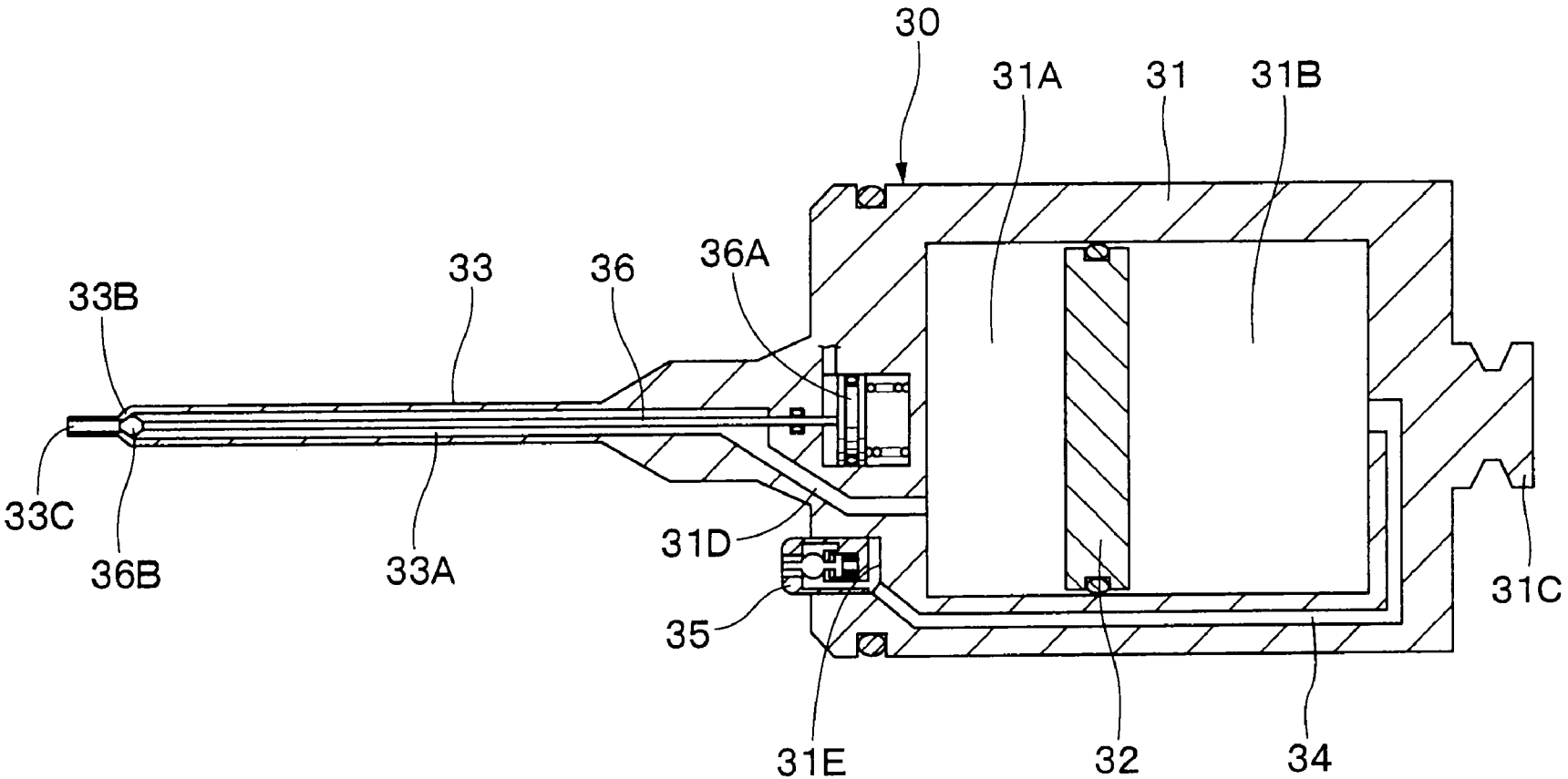
FIG. 4 is a longitudinal sectional view of a paint cartridge alone.

Indicated at 34 is an extruding liquid passage on the side of the paint cartridge, which is provided on the tank portion 31 in communication with the extruding liquid chamber 31B (FIGS. 2 and 4). This extruding liquid passage 34 is communicated with the extruding liquid passage 7 on the side of the housing when the paint cartridge 30 is set in the cartridge mount portion 5 on the main body 2. Further, the extruding liquid passage 34 is communicated with an extruding liquid passage on the side of a replenishing stool (now shown) when the paint cartridge 30 is set on the replenishing stool 46.

Indicated at 35 is a quick joint with a check valve, which is inwardly positioned at the joint mount portion 31E of the tank portion 31 and provided at an open end of the extruding liquid passage 34 on the side of the paint cartridge. This quick joint 35 is opened when the paint cartridge is attached to the main body 2 of the coating apparatus 1 or to a replenishing stool 46 at the paint replenishing unit 44. On the other hand, upon detaching or dismantling from the main body 2 or from a replenishing stool 46, the quick joint 35 is closed to prevent outflow of an extruding liquid from the extruding liquid passage 34 on the side of the cartridge.

Indicated at 36 is a paint valve which is provided in the front side portion of the tank portion 31. This paint valve 36 is provided for on-off control of paint supply from the feed tube 33 to the paint nozzle 23. For this purpose, the paint valve 36 is constituted by an axially displaceable piston 36A, and a valve body 36B which is inwardly extended forward from the piston 36A through a paint supply passage 33A of the feed tube 33 to for seating on and off the valve seat portion 33B.

Now, given below is a description on a structure for supplying a wash fluid which is provided externally of the coating apparatus 1, with reference to FIG. 6.

Designated at 37 is a wash fluid source device including a wash air source 37Ar and a wash liquid source 37Lq for supply of wash air and a wash liquid (e.g., water). The wash fluid source device 37 is connected to the upstream supply passage 9A of the first wash fluid passage 9 on the coating apparatus 1 via a wash fluid selector valve 38, as described below.

Indicated at 38 is a wash fluid selector valve which is connected between the wash fluid source device 37 and the wash fluid passage change-over valve 19. For example, this wash fluid selector valve 38 is constituted by a couple of on-off valves which are connected to the wash air source 37Ar and the wash liquid source 37Lq of the wash fluid source device 37, respectively. Wash air and wash liquid are alternately fed from the wash fluid selector valve 38 at the time of washing previous color paint residues off the spray nozzle 22.

Indicated at 39 is an atomizing air source which is connected to the atomizing air passage 26 on the coating apparatus 1 through an atomizing air valve 40 for supply of atomizing air. Further, indicated at 41 is a pattern air source which is connected to the pattern air passage 27 on the coating apparatus 1 through a pattern air valve 42 for supply of pattern control air.

Indicated at 43 is a coating robot (see FIG. 1) by which the coating apparatus 1 is put in a universal transference. This coating robot 43 is largely constituted by a mount base 43A, a vertical arm 43B which is rotatably and pivotally supported on the mount base 43A, a horizontal arm 43C which is pivotally connected to a fore distal end of the vertical arm 43B, and a wrist 43D which is connected to a fore distal end of the horizontal arm 43C. The holder portion 3A of the housing 3 of the main body 2 of the coating apparatus 1 is mounted on the wrist 43D.

Denoted at 44 is a paint replenishing unit which is located within an operating range of the coating robot 43. At this paint replenishing unit 44, paint cartridges 30 are refilled with the respective paint colors, i.e., color-a, color-b through color-n. Furthermore, the paint replenishing unit 44 provides replenishing stools 46 of respective colors which detachably mount corresponding paint cartridges 30 on a deck 45.

Figure 14:
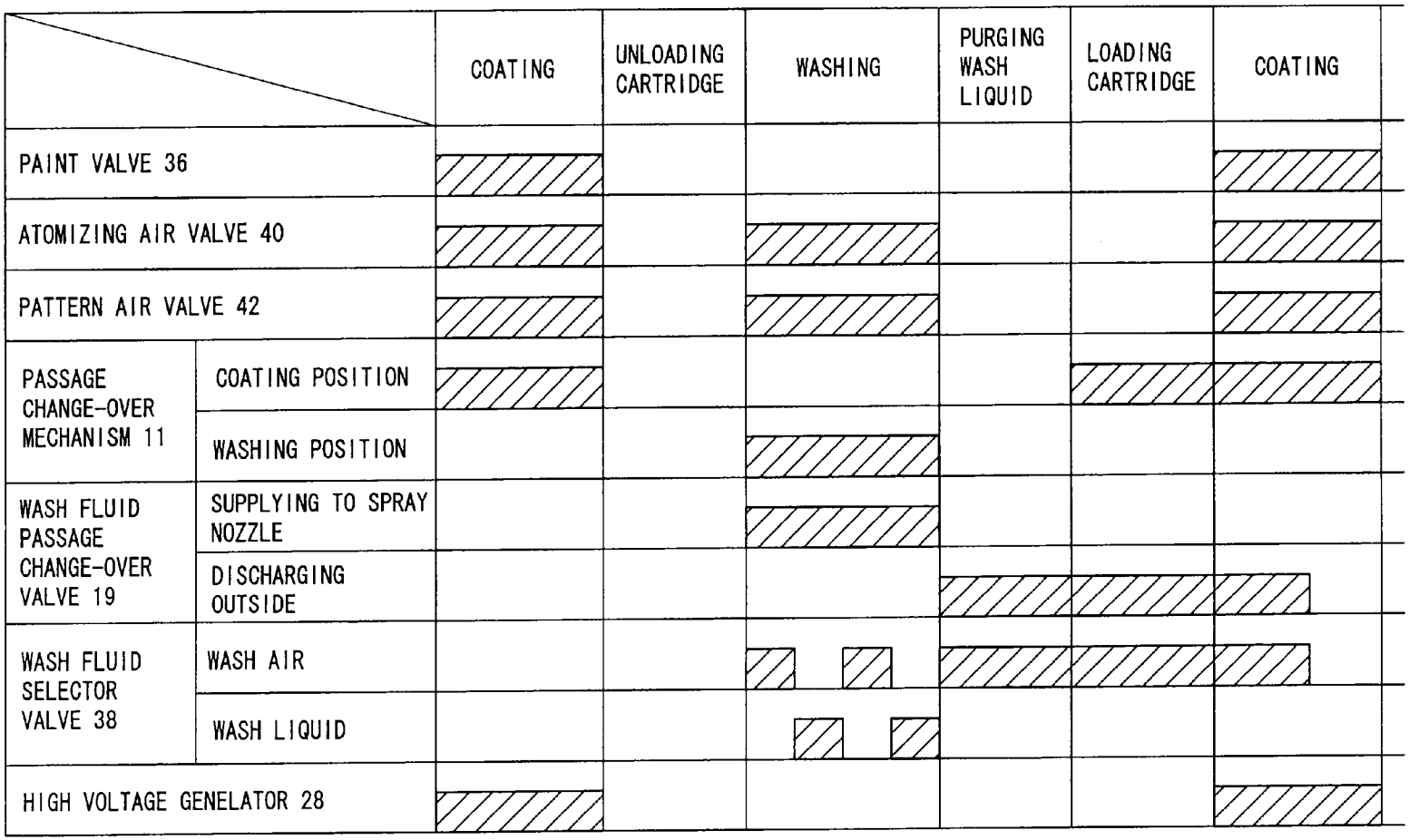
FIG. 14 is a control time chart of the air atomizing type coating apparatus of the first embodiment.

Being arranged as described above, the air atomizing type coating apparatus 1 of the first embodiment is put in a coating operation and in a washing operation, in the manner as described in greater detail below with reference to the time chart of FIG. 14.

In the first place, in a state of coating operation, a paint cartridge 30 is attached to the coating apparatus 1 of the main body 2, and, at this time, the ball valve body 13 of the passage change-over mechanism 11 is switched to a coating position, permitting insertion of a feed tube 33 into the second feed tube passage hole 14 as shown in FIGS. 5, 7, 9 and 11.

When in a coating operation, the paint valve 36 of the paint cartridge 30 is opened to let the paint spurting out from the paint nozzle 33 through the paint nozzle 23 of the spray nozzle 22. At this time, the atomizing air valve 40 is opened to spurt atomizing air out of the respective atomizing air spurting holes 24D of the air nozzle 24 to atomize paint. At the same time, the pattern air valve 42 is opened to spurt out pattern control air through the pattern air spurting holes 24E of the air nozzle 24 to form the atomizing air in a desired spray pattern.

Further, a high voltage is applied to spraying paint by the high voltage generator 28. In this case, as a result of adoption of the paint cartridges 30, a paint feed pipe and the like can be abolished, and a high voltage can be applied to the front body 4 from the high voltage generator 28 in an insulated state (in a floated state) relative to the earth potential. That is to say, there is no possibility of leaks of high voltage to the side of the earth ground unless short-circuiting takes place from the front body 4 of the main body 2 to the earth ground through the first wash fluid passage 9, atomizing air passage 26 and pattern air passage 27, and the like.

Upon completion of a coating operation, the process shift to the paint cartridge 30 unloading operation, dismantling the used paint cartridge 30 from the cartridge mount portion 5 of the housing 3.

Upon unloading the paint cartridge 30 from the housing 3, a washing operation follows thereby to wash off a previous color from the spray nozzle 22 in the manner as described below.

In the first place, for supply of wash fluids to the spray nozzle 22, the ball valve body 13 of the passage change-over mechanism 11 is turned in the direction of arrow B by the air cylinder 18 for a switch to a washing position, as shown in FIGS. 8, 10 and 12. In this washing position of the ball valve body 13, the second wash fluid passage 15 is communicated with the first wash fluid passage 9 and the third feed tube passage hole 16 to supply wash fluids from the first wash fluid passage 9 to the spray nozzle 22. In addition, the wash fluid passage change-over valve 19 is changed over to connect the upstream supply passage 9A of the first wash fluid passage 9 with the downstream supply passage 9B.

Further, the atomizing air valve 40 as well as the pattern air valve 42 is opened to spurt out atomizing air along with pattern air. In this state, the wash fluid selector valve 38 is changed over to supply wash air alone in the first place.

Whereupon, wash air is supplied to the spray nozzle 22 through the upstream supply passage 9A and downstream supply passage 9B of the first wash fluid passage 9, second wash fluid passage 15, and third feed tube passage hole 16. As a consequence, paint residues of a previous color lingering in the third feed tube passage hole 16 and the paint spurting hole 23C of the paint nozzle 23 are pushed out and discharged by blasts of wash air. Upon supplying a wash liquid to those deposited portions succeedingly, sticking paint can be washed away. In this manner, wash air and wash liquid are supplied alternately for several times.

In this instance, when the ball valve body 13 is switched to the washing position, communication between the first feed tube passage hole 6 and the valve body receptacle hole 12C of the valve case 12 is blocked by the valve seat member 17. Therefore, wash air and wash liquid flowing through the first wash fluid passage 9 are totally supplied to the spray nozzle 22 without being introduced into the first feed tube passage hole 6, permitting to wash off a previous color in an efficient manner.

Further, as the paint cartridge 30 is detached from the main body 2, the feed tube 33 comes out together with the paint cartridge 30. Therefore, now it is only the spray nozzle 22 in or on which a previous color still remains. That is to say, it is only the spray nozzle 22 that requires a washing operation, and therefore a washing operation can be carried out in a more assured manner within a shorter time period by the use of reduced amounts of wash fluids.

The washing operation for the spray nozzle 22 is followed by a wash liquid purging operation to remove residues of a wash fluid such as water or thinner from the upstream supply passage 9A of the first wash fluid passage 9. In the wash liquid purging operation, wash air is supplied after switching the wash fluid selector valve 38 to connect the upstream supply passage 9A of the first wash fluid passage 9 with the discharge passage 9C. The purge of wash liquid residues prevents leakage of high voltage which may otherwise occur through wash liquid residues.

In case of a wash liquid of low volatility like water, it may be found difficult to purge (dry off) the wash liquid completely within a predetermined time period of the washing operation. In a case where the wash liquid is water, for example, wash air is kept flowing from the upstream supply passage 9A of the first wash fluid passage 9 to the discharge passage 9C even after the above washing operation and during a cartridge changing operation and a painting operation as well to purge (dry off) wash liquid residues in an assured manner.

Now, upon completion of a washing operation, a loading operation of a paint cartridge 30 of a next color follows. In the paint cartridge 30 loading operation, the ball valve body 13 of the passage change-over mechanism 11 is switched to the coating position, permitting placement of a feed tube 33 into the second feed tube passage hole 14. Thereafter, the feed tube 33 of the paint cartridge 30 is successively passed into the first feed tube passage hole 6, second feed tube passage hole 14 and third feed tube passage hole 16, and the tank portion 31 is set in the cartridge mount portion 5 on the main body 2. Whereby, it is possible to fix the paint cartridge 30 of next color to the main body 2.

In the next place, namely, upon completion of the paint cartridge 30 loading operation, a coating operation is started to paint a work piece by putting the coating apparatus 1 in action (in operation) in the same manner as in the paint coating operation described hereinbefore.

As described above, according to the first embodiment of the present invention, the passage change-over mechanism 11 is attached to the front body 4 of the main body 2 thereby to selectively set the coating apparatus 1 either in a coating position or in a washing position by shifting the second feed tube passage hole 14 into a coaxially communicating position relative to the first feed tube passage hole 6 or by shifting the second wash fluid passage 15 to a coaxially communicating position relative to the first wash fluid passage 9. Accordingly, by switching the ball valve body 13 of the passage change-over mechanism 11 to a washing position, a previous color which has deposited on the spray nozzle 22 can be washed off and removed securely within a shortened time period. On the other hand, when the ball valve body 13 of the passage change-over mechanism 11 is switched to a coating position, a paint cartridge 30 can be attached to the main body 2.

Thus, in a coating operation, paint cartridges 30 can be interchangeably attached and detached to and from the air atomizing type coating apparatus 1 with the air atomizing type spray nozzle 22, permitting to carry out an operating efficiency of a color change operation and a washing operation and the like and a finish coating quality in an assured manner.

Further, in the case of the paint feed system utilizing the paint cartridges 30, the feed tube 33 which forms a paint supply passage can be extracted or removed at the time of a washing operation. That is to say, it is only the spray nozzle 22 that requires washing. This means that a washing time as well as consumption of wash fluids can be cut to a considerable degree.

Further, the use of the paint cartridge 30 can preclude the possibilities of leakage of a directly applied high voltage which might otherwise take place through a paint feed pipe. Thus, paint can be charged with a high voltage by the use of a direct charging system employing the high voltage generator 28 to directly charge paint to be sprayed from the spray nozzle 22. It follows that, even in the case of the coating apparatus 1 which is equipped with the air atomizing type spray nozzle 22, all of paint particles which are sprayed from the spray nozzle 22 can be charged with a high voltage stably to ensure high paint deposition efficiency as well as satisfactory finish quality.

On the other hand, by rotating the ball valve body 13 of the passage change-over mechanism 11 by the air cylinder 18, the ball valve body 13 can be easily switched between a coating position and a washing position. Accordingly, at the time of a coating operation, the second feed tube passage hole 14 can be easily brought into communication with the first feed tube passage hole 6. On the other hand, at the time of a washing communication, the second wash fluid passage 15 can be easily brought into communication with the first wash fluid passage 9, while blocking communication between the first and second feed tube passage holes 6 and 14.

The air cylinder 18 which is mounted on the front body 4 of the main body 2 to rotate the ball valve body 13 can afford an ample installation space for performing its functions.

On the other hand, the valve seat member 17 is provided on the valve case 12 of the passage change-over mechanism 11 to provide a hermetical seal around the outer periphery of the ball valve body 13. Accordingly, it can block a flow of a wash fluid into the first feed tube passage hole 6 from the first wash fluid passage 9 in a reliable manner to supply the entire wash fluid to the spray nozzle 22, permitting to shorten a washing time to a significant degree.

Further, the wash fluid passage change-over valve 19 is provided in the course of the first wash fluid passage 9. At the time of washing the spray nozzle 22, a supply route of a wash fluid from the wash fluid source device 37 is switched by the wash fluid passage change-over valve 19 to the side of the passage change-over mechanism 11. As a result, a wash fluid can be supplied to the spray nozzle 22 through the passage change-over mechanism 11 to clean the spray nozzle 22.

Besides, after a washing operation, the wash fluid supply route is switched by the wash fluid passage change-over valve 19 to let wash air flow toward the waste liquid tank 10. Thus, even after a washing operation, wash air is kept flowing through the wash fluid passage 9 in subsequent stages, i.e., during a cartridge mounting operation and during a coating operation, to purge (dry off) residues of a wash liquid in an assured manner. This makes it possible to adopt a direct charging system on an air atomizing type coating apparatus for the purpose of improving deposition efficiency and finish quality of the coating.

Furthermore, the passage change-over mechanism 11 is detachably attached on the housing 3 by the use of a cover constituted by the cover tube 20 and the fastener ring 21. Thus, the passage change-over mechanism 11 can be protected in a concealed state within the cover tube 20. Besides, the passage change-over mechanism 11 can be detachably attached to the main body 2 simply through utilization of the cover tube 20 and fastener ring 21. That is to say, the passage change-over mechanism 11 can be mounted and dismantled readily by the use of a reduced number of parts and through a reduced number of steps.

Figure 15:
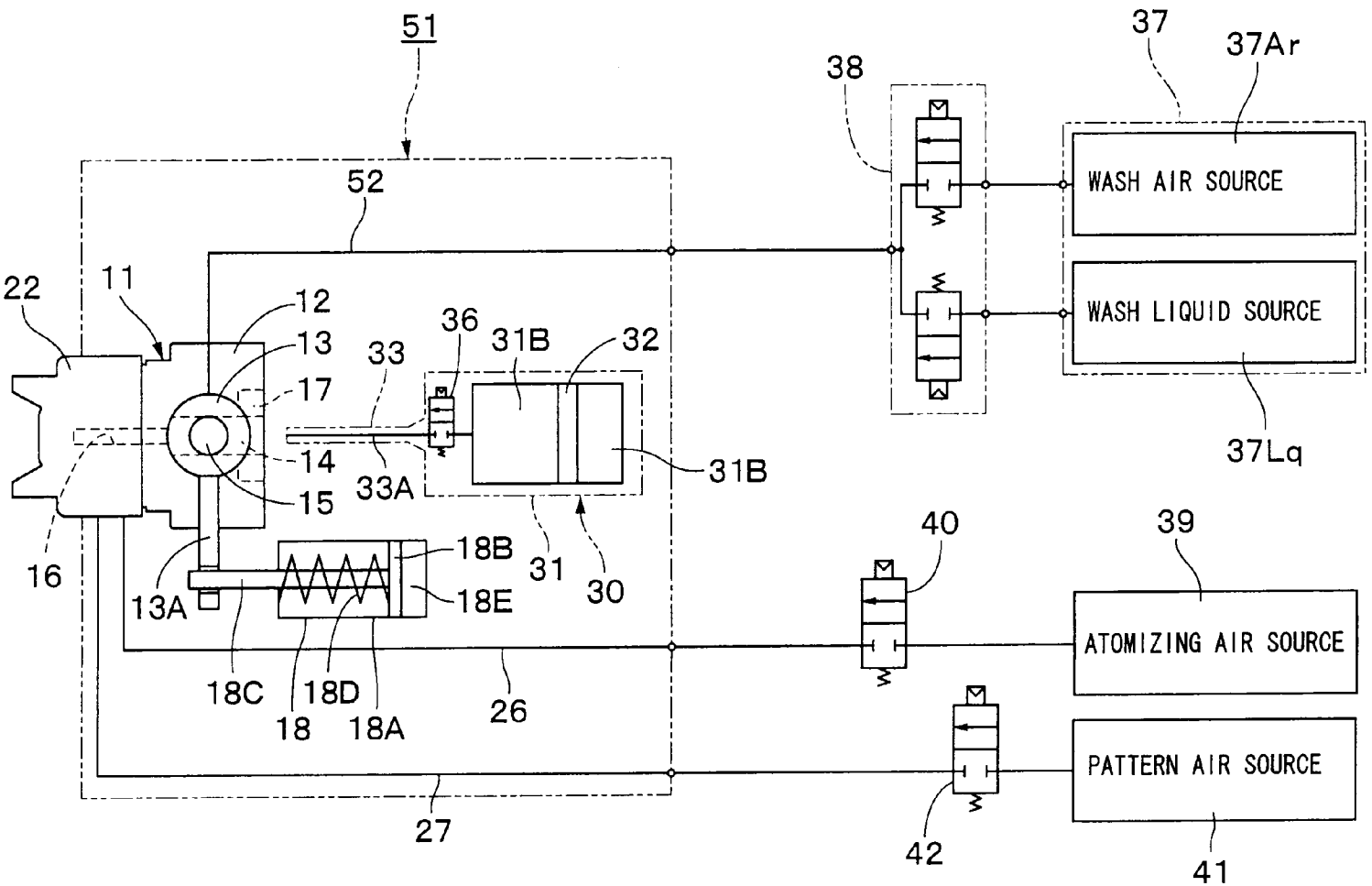
FIG. 15 is a circuit diagram of an air atomizing type coating apparatus in general arrangement according to a second embodiment of the present invention.

Now, turning to FIG. 15, there is shown a second embodiment of the present invention. This embodiment has a feature in abolishment of a wash fluid passage change-over valve. In the following description of the second embodiment, those component parts which are identical with a counterpart in the foregoing first embodiment are simply designated by the same reference numeral or character to avoid repetitions of similar descriptions.

In FIG. 15, indicated at 51 is an air atomizing type paint coating apparatus 1 (hereinafter simply referred to as "coating apparatus" for brevity) in a second embodiment of the invention. The coating apparatus 51 of this embodiment is provided with a single wash fluid passage 52 instead of the wash fluid passage change-over valve 19 in the first embodiment. Namely, the coating apparatus 51 of the second embodiment differs from that of the first embodiment in that it is arranged to connect the wash fluid selector valve 38 with the passage change-over mechanism 11 by means of the wash fluid passage 52.

Thus, the second embodiment, with the above-mentioned alteration, can produce substantially the same operational effects as the foregoing first embodiment. Especially in the case of the second embodiment, the coating apparatus 51 is simplified in construction by the abolishment of a wash fluid passage change-over valve. Further, the second embodiment is particularly suitable for application to coating operations using, as a wash liquid, a solvent which dries up within a short time period like thinner or a solvent which is high in electrical resistance.

In the above-described first embodiment, by way of example the air cylinder 18 is employed as an actuator for turning the ball valve body 13 of the passage change-over mechanism 11. However, the present invention is not limited to the particular example shown. For instance, an air motor or other actuator may be employed for turning the ball valve body 13. The same applies to the second embodiment.

Further, in the first embodiment, by way of example the ball valve body 13 of a spherical shape is employed as a valve body of the passage change-over mechanism 11. However, the present invention is not limited to this particular example shown. For instance, a cylindrical rotational valve body (a rotary valve body) or a reciprocating spool valve body may be employed if desired. The same applies to the second embodiment.

Further, in the first embodiment, by way of example a direct charging system is employed for directly applying a high voltage to paint to be sprayed from the spray nozzle 22 by the high voltage generator 28. However, the present invention is not limited to the particular example shown. For instance, the direct charging system may be replaced by an indirect charging system by use of external electrodes, or may be abolished if desired. The same applies to the second embodiment.

The invention claimed is:

1. An air atomizing type coating apparatus, comprised of:

a main body formed with a cartridge mount portion and a passage change-over means mount portion at rear and front sides thereof, respectively, along with a first feed tube passage hole extending forward from said cartridge mount portion toward said passage change-over means mount portion;

a first wash fluid passage provided on said main body to supply therethrough a wash fluid for washing off paint residues;

a passage change-over means attached to said passage change-over means mount portion of said main body and provided with a second feed tube passage hole which is in a coaxially communicating position relative to said first feed tube passage hole, and a second wash fluid passage which is in a communicating position relative to said first wash fluid passage, and selectively switching either said second feed tube passage hole or said second wash fluid passage;

an air atomizing type spraying means attached on a front side of said passage change-over means, and composed of a paint nozzle adapted to spurt paint forward and an air nozzle adapted to blow atomizing air to atomize paint from said paint nozzle; and a paint cartridge composed of a tank portion which store paint and a feed tube projected forward from said tank portion, said feed tube being passed into said first and second feed tube passage holes and when said tank portion is set in said cartridge mount portion.

2. An air atomizing type coating apparatus as defined in claim 1, wherein said passage change-over means comprises a valve case attached to said passage change-over means mount portion of said main body, a valve body rotatably fitted in said valve case and internally formed with a second feed tube passage hole and a second wash fluid passage, and an actuator adapted to turn said valve body.

3. An air atomizing type coating apparatus as defined in claim 2, wherein said valve body of said passage change-over means is in the form of a spherically shaped ball valve body and internally formed with a diametrically extended second feed tube passage hole and a radially extended second wash fluid passage intersecting with each other in T-shape.

4. An air atomizing type coating apparatus as defined in claim 2, wherein said actuator of said passage change-over means is mounted on said main body and adapted to turn a valve shaft of said valve body.

5. An air atomizing type coating apparatus as defined in claim 2, further comprising a valve seat member provided in said valve case of said passage change-over means, said valve seat member providing a hermetical seal around exterior surfaces of said valve body to prevent a wash fluid supplied from said first wash fluid passage to flow into said first feed tube passage hole.

6. An air atomizing type coating apparatus as defined in claim 1, further comprising a wash fluid passage change-over valve in the course of said first wash fluid passage to switch a supply of a wash fluid from a wash fluid source device between a passage on the side of said passage change-over means and a passage on the side of an external waste liquid tank.

7. An air atomizing type coating apparatus as defined in claim 1, further comprising a cover adapted to enshroud outer peripheral side of said passage change-over means, which said passage change-over means being detachably attached to said passage change-over means mount portion of said main body by the use of said cover.

8. An air atomizing type coating apparatus as defined in claim 2, wherein said valve case of said passage change-over means is provided with a projection tube in a coaxially aligned position relative to said first feed tube passage hole of said main body and a third feed tube passage hole to receive therein a fore end portion of said feed tube;

said paint nozzle of said paint atomizing means is comprised of a paint nozzle body attached on a front side of said passage change-over means, a projection tube receptacle hole formed on the rear side of said paint nozzle body to receive therein said projection tube, and a paint spurting hole formed at a fore end of said paint nozzle body to spout paint in supply through said projection tube;and said air nozzle is comprised of an air nozzle body located around outer periphery of said paint nozzle body and attached to said passage change-over means through a retainer ring, atomizing air spurting holes formed in said air nozzle body at positions around said paint spurting hole of said paint nozzle body, and pattern air spurting holes formed in horn portions in diametrically opposing positions radially on the outer side of said atomizing air spurting holes.

* * * * *